US005411839A

United States Patent [19]

Harder et al.

[11] Patent Number: 5,411,839

[45] Date of Patent: * May 2, 1995

[54] IMAGE FORMATION IN COLOR REVERSAL MATERIALS USING STRONG INHIBITORS

[75] Inventors: John W. Harder; Paul A. Burns, both of Rochester; J. Ramon Vargas, Webster; Arlyce T. Bowne, Rochester; Philip D. Knight, Fairport; William J. Begley, Webster; Hans G. Ling, Rochester, all of N.Y.

[73] Assignee: Eastman Kodak Company, Rochester, N.Y.

[ * ] Notice: The portion of the term of this patent subsequent to Jan. 3, 2012 has been disclaimed.

[21] Appl. No.: 4,027

[22] Filed: Jan. 15, 1993

[51] Int. Cl.[6] ..... G03C 7/46

[52] U.S. Cl. ..... 430/379; 430/505; 430/544; 430/957; 430/359

[58] Field of Search ..... 430/957, 505, 544, 407, 430/359, 379

[56] References Cited

U.S. PATENT DOCUMENTS

| | | | |
|---|---|---|---|
| 4,461,826 | 7/1984 | Yamashita et al. | 430/505 |
| 4,480,028 | 10/1984 | Kato et al. | 430/544 |
| 4,482,629 | 11/1984 | Nakagawa et al. | 430/542 |
| 4,618,571 | 10/1986 | Ichijima et al. | 430/505 |
| 4,729,943 | 3/1988 | Pfaff et al. | 430/362 |
| 4,962,018 | 10/1990 | Szajewski et al. | 430/544 |
| 5,006,448 | 4/1991 | Szajewski | 430/957 |
| 5,024,925 | 6/1991 | Deguchi | 430/379 |
| 5,156,944 | 10/1992 | Inoie et al. | 430/505 |

FOREIGN PATENT DOCUMENTS

| | | |
|---|---|---|
| 0296784 | 12/1988 | European Pat. Off. . |
| 0296785 | 12/1988 | European Pat. Off. . |
| 0349331 | 6/1989 | European Pat. Off. . |
| 0481427 | 4/1992 | European Pat. Off. . |
| 4135312 | 4/1992 | Germany . |
| 4200322 | 7/1993 | Germany . |
| 2-251950 | 10/1990 | Japan . |

OTHER PUBLICATIONS

*Research Disclosure* 15854, vol. 158, Jun. 1977, pp. 35–38.

*Primary Examiner*—Charles L. Bowers, Jr.
*Assistant Examiner*—Geraldine Letscher
*Attorney, Agent, or Firm*—Gordon M. Stewart

[57] ABSTRACT

An improved color reversal element comprising: a support having thereon at least two light-sensitive silver halide emulsion layers and a compound capable of releasing a development inhibitor, the element comprising a compound having the structural formula $$\text{CAR—(TIME)}_n\text{—INH}$$

wherein:

CAR is a carrier moiety from which —(TIME)$_n$—INH is released during color development;

TIME is a timing group; INH is comprised of a development inhibitor moiety selected from the group consisting of oxazole, thiazole, diazole, oxathiazole, triazole, thiatriazole, benzotriazole, tetrazole, benzimidazole, indazole, isoindazole, mercaptotriazole, mercaptothiadiazole, mercaptotetrazole, selenotetrazole, mercaptothiazole, selenobenzothiazole, mercaptobenzoxazole, selenobenzoxazole, mercaptobenzimidazole, mercaptobenzothiazole, selenobenzimidazole, benzodiazole, mercaptooxadiazole, or benzisodiazole, the INH havina an inhibitor strength greater than 1 (one), and n is 0, 1 or 2.

30 Claims, No Drawings

IMAGE FORMATION IN COLOR REVERSAL MATERIALS USING STRONG INHIBITORS

This invention relates to color reversal photography. In a particular aspect, it relates to improved images in color reversal photography. The invention employs a color reversal material, e.g. film, having an image modifying compound in an image forming layer which provides saturation in certain colors while providing less saturation in other colors or similar colors.

Development inhibitor releasing (DIR) compounds which are active during color development are not commonly employed in color reversal films. In fact, it is stated in T. H. James, ed., *The theory of the Photographic Process,* 4th Ed., Macmillan Pub. Co., N.Y., p. 611, that DIR compounds do not have much effect in reversal systems in view of the exhaustive development which occurs in the development step. Further, in a recent patent application, EPO481427, (1991), it is noted that a DIR coupler has been known as an additive of a color negative film. A development inhibitor is released from the coupler in the color development process of a color photographic material. Using the DIR coupler, the sharpness of the image is improved by an edge effect, which is caused by the difference in the density of the released development inhibitor. The DIR coupler is effective in a color developing process of a color negative film or a color paper. However, the effect of the DIR coupler cannot be expected in other color photographic materials such as a color reversal film, a color reversal paper, and a black and white photographic material, since the main process in the image formation of these photographic materials is a black and white development.

Because of the problems of using DIR compounds in color reversal material, it is usually indicated, for example, that they should be used with color development that is less exhaustive than what is commonly used today. For example, it has been suggested that the color development time be reduced. All reversal films today are compatible in that they can be developed in common commercial processing. Any film which is designed for non-exhaustive development would require identification and special processing which would make it commercially undesirable. When used in color reversal materials, DIR compounds have been utilized in a layer that contains a silver halide emulsion that does not contribute to image formation.

All these suggestions have serious drawbacks. For example, any methodology that uses less exhaustive color development lessens the effects that make exhaustive development an advantage, and a standard technique in the color reversal photographic arts.

To overcome the problems attendant the use of DIR compounds in color reversal materials, it has been discovered that interimage or color reproduction advantages, for example, in a color reversal material can be enabled by DIR compounds that release strong inhibitors or that release fragments that release strong inhibitors. The strong inhibitors permit the use of conventional development processes for color reversal material. Strong inhibitors are those that show greater restraint in silver development, for example, when compared to phenylmercaptotetrazole when tested as described herein or that have a diffusivity value lower than that given by phenylmercaptotetrazole, for example, described in EP296,784.

Strong inhibitors in accordance with the invention have the additional advantage of increasing sharpness without modification of the conventional developing processes.

For purposes of this invention, conventional development processes include the E-6 process as described in *Manual For Processing Kodak Ektachrome Films Using E-6*, (1980) Eastman Kodak Company, Rochester, N.Y., or a substantially equivalent process made available by a company other than Eastman Kodak Company, are referred to as "current" color reversal processes or "standard" processes. Current reversal processes employ as a color developer, 4-(N-ethyl-N-2-methylsulfonylaminoethylino)-2-methylphenylenediamine sesguisulfate, 1-hydrate in a concentration of from about 7 to about 11 grams per 1000 ml of water, and as a silver halide solvent, 2,2-ethylenedithioethanol (also known as Dithiaoctanediol) in a concentration of about 0.6 to about 1.2 grams per 1000 ml of water. The pH of the color developing agent is from about 11.6 to about 12.1. The color developing agent is used in the process for about from 5.5 to 7.0 minutes at a temperature of from 36.6 to 39.4 C.

*Research Disclosure* 15854, vol. 158, June 1977, pp. 35–38, "Method for Forming Reversal Color Images" Anon. describes the use of DIR couplers in incorporated coupler reversal systems, and lists mercaptotetrazole and benzotriazole releasing DIR compounds.

Pffaf et al., U.S. Pat. No. 4,729,943, describe the use of DIR couplers in a reversal system where the DIR coupler is contained in a silver halide emulsion layer. However, this layer is separate from the silver halide imaging layer producing the primary dye image. The DIR couplers described release mercaptotetrazole inhibitor fragments and requires a color development time of 1 to 2 minutes.

Japanese Published Application No. 2,251,950 discloses silver halide based, color photographic material containing at least one compound which has a carboxyester-substituted mercaptothiadizole or mercaptooxadiazole fragment. Color reversal materials are referred to having color development times of 2 to 5 minutes.

European Application No. 296,784 discloses reversal film in which a DIR compound is incorporated in a layer with a silver halide emulsion that does not substantially contribute to image formation. The DIR compound releases an inhibiting moiety with a diffusivity value of 0.34 or greater, preferably with a value of 0.4 or greater.

European Application No. 296,785 discloses reversal film which comprises a support and photographic component layers including at least two silver halide emulsion layers having different spectral sensitivity from each other. However, this Application is concerned with silver halide emulsion layers which contain a pyrazoloazole type magenta coupler.

U.S. Pat. No. 4,618,571 discloses the use of certain DIR couplers in color reversal photographic material. In these references, the DIR compounds or couplers release inhibitors which do not work satisfactorily in conventional color reversal developing processes.

Thus, it will be seen that the art either teaches away from the use of DIR compounds in reversal materials because of the problems noted or modifies standard procedures to accommodate their use which often is unsatisfactory.

Thus it will be seen that a great need has existed in color reversal photographic silver halide elements to provide enhanced interimage effects and acutance or sharpness advantages by the use of image modifying chemistry which work with conventional color reversal development processes.

The present invention fulfills this need and overcomes the problems relating to the use of DIR compounds or couplers in color reversal material by providing an improved color reversal element comprising:

a support having thereon at least two color-forming light-sensitive silver halide emulsion layers and a compound capable of releasing a development inhibitor, the element comprising a compound (I) having the structural formula $$CAR—(TIME)_n—INH$$

wherein:

CAR is a carrier moiety from which —(TIME)$_n$—INH is released during color development;

TIME is a timing group;

INH is comprised of a development inhibitor moiety selected from the group consisting of oxazole, thiazole, diazole, oxathiazole, triazole, thiatriazole, benzotriazole, tetrazole, benzimidazole, indazole, isoindazole, mercaptotriazole, mercaptothiadiazole, mercaptotetrazole, selenotetrazole, mercaptothiazole, selenobenzothiazole, mercaptobenzoxazole, selenobenzoxazole, mercaptobenzimidazole, mercaptobenzothiazole, selenobenzimidazole, benzodiazole, mercaptooxadiazole, or benzisodiazole, the INH of the compound having an inhibitor strength greater than 1 (one) referred to herein as a strong inhibitor; and n is 0, 1 or 2.

This invention provides for the use of strong inhibitors or inhibitors fragments. Although not bound by any theory, it is believed that the strong inhibitors or inhibitor fragments released during the color reversal process is a color development inhibitor which is sufficiently strong to allow image modification that results in increased sharpness to take place and improved color reproduction, e.g. increasing saturation in one color without substantially increasing color saturation in a similar color, for example, saturating reds while not substantially saturating flesh color and thus maintaining more accurate reproduction of flesh color. That is, the inhibitors have to be selected carefully to obtain the improved image modification.

Thus, the very strong inhibitor fragments released by compounds employed in this invention enable the use of the E-6 type development process with DIR compounds or couplers of the invention with desirable image modifying advantages.

The inhibitor number, IN, of the INH compound is defined as:

$$IN = \frac{D_{max}\text{ (solution A)} - D_{max}\text{ (solution B)}}{D_{max}\text{ (solution A)}} \times 100$$

wherein IN is greater than 35 and is preferably greater than 50 with a typical IN being about 60.

The inhibitor strength, IS, (also referenced herein as inhibitor potency) of the INH compound is defined as:

$$IS = \frac{IN_{(test)}}{IN_{(control)}}$$

where $IN_{(test)}$ is the inhibitor number determined by the method described above for any INH compound of interest, and $IN_{(control)}$ is the inhibitor number determined for the test coating when 1-phenyl-5-mercapto-1,2,3,4-tetrazole is the INH compound incorporated into the color developer. In the present invention IS equal to or greater than 1 (one) and is preferably greater than 1.2 with a typical IS being about 1.6.

It has been found that compounds having the structural formula $$CAR—(TIME)_n—INH$$

wherein INH comprises a compound that has a inhibitor strength greater than 1 provide particularly desirable results when incorporated into color reversal photographic elements.

For the purposes of this invention, acutance and sharpness are used interchangeably. Moreover, for the purposes of this invention, acutance is used as a measure of sharpness in an image. The term acutance is defined and described on pages 602–604 of T. H. James, *The Theory of the Photographic Process,* Fourth Edition, Macmillan Publishing Co., Inc., New York, N.Y. (1977).

For the purpose of this invention, color reversal materials are of the type suited for development in a color reversal process.

In reversal processes yielding color positives such as the Kodachrome, Ektachrome, and Agfacolor processes, and so on, the latent image is developed first in a black-and-white (non-chromogenic) developer, thus using up the exposed silver halide without dye formation. Then, the residual silver halide is rendered developable either by exposure or by chemically fogging. A second or subsequent development step with a chromogenic developer results in a coupling reaction between a coupler compound and oxidized chromogenic developer. This leads in the blue-sensitive layer, to formation of a yellow dye, in the green-sensitive layer to formation of a magenta dye, and in the red-sensitive layer to formation of a cyan dye. All of the developed silver is then removed. Magenta plus cyan appears blue, yellow plus cyan appears green, and yellow plus magenta appears red, the result thus reproducing the color patches of the test object.

If the test object is white, all the silver halide in the film will be used up by the black-and-white (first) developer, and no dyes will be formed during the second or subsequent (color) development. Conversely, if the test object is black, all silver halide will be available for color development and the superposition of yellow, magenta, and cyan will cause complete opacity, that is, the result will appear black.

Color reversal films have higher contrasts and shorter exposure latitudes than color negative film. Moreover, such reversal films do not have masking couplers, and this further differentiates reversal from negative working films. Furthermore, reversal films have a gamma generally between 1.5 and 2.0, and this is much higher than for negative materials.

Color reversal material, e.g. film, can be developed in the well known, widely employed E-6 color reversal development process described in the Eastman Kodak Company manual cited above, or a substantially equivalent process.

In accordance with the invention, there is provided a color reversal photographic element comprising a support bearing a red-sensitive, cyan dye-forming unit, a green-sensitive, magenta dye-forming unit, and a blue-sensitive, yellow dye-forming unit, each unit comprising at least one photosensitive silver halide layer and an image dye-forming compound; said element containing an interimage effect-controlling means; said interimage effect-controlling means being characterized as having the capability of simultaneously forming a red image of high saturation or relative chroma and a reddish tint image of substantially lower red saturation or relative chroma when said element is exposed to a red color standard object and a reddish tint color standard object and thereafter developed; said red color standard object having CIELab values $a^*=30.46$, $b^*=19.16$, $C^*=35.98$, $L^*=40.12$; said reddish tint color standard object having CIELab values $a^*=17.26$, $b^*=18.01$, $C^*=24.95$, $L^*=66.98$; the resulting said images having a red reproduction coefficient equal to or greater than 0.88 and a ratio of red reproduction coefficient to reddish tint reproduction coefficient equal to or greater than 1.15.

The color reversal photographic element of the present invention simultaneously provides the reproduction of a saturated or high chroma color with high relative chroma, e.g. saturated red color, and a reddish tint color, such as a skin tone, in a pleasing manner.

The methods described in the prior art for the improvement of color reproduction in color reversal photographic materials by the operation of interlayer interimage effects are incapable of simultaneously producing colors of high saturation or relative chroma and similar colors of low saturation or relative chroma because the resulting increases in the chroma of the reproduction of the saturated colors are typically accompanied by similar or even larger increases in the chroma of the colors of low saturation or relative chroma. Thus, for example, improving the saturation or increasing the chroma of reproduced red objects is achieved with an attendant unpleasing increase in saturation or chroma of light skin tones.

To overcome this undesirable result, it is necessary to provide non-linear interimage effects that are enhanced in the upper positive sensitometric scale relative to the lower portion of the scale. In accordance with the present invention, this is achieved either by increasing chroma in the high density region and/or decreasing chroma in the low density region. The interimage effect-controlling means can operate in the non-chromogenic development step of the process, or in the chromogenic development step, or in both. At least one light-sensitive silver halide emulsion layer and/or at least one substantially light-insensitive hydrophilic colloidal layer in close proximity thereto comprises the interimage effect-controlling means.

In accordance with the present invention, various interimage effect-controlling means can be employed, either singly or in combination, to achieve the color reproduction objects. For example, DIR compounds can be employed in the color reversal photographic element of the invention, preferably in the cyan dye-forming unit, and more preferably in a fast red-sensitive silver halide layer in said cyan dye-forming unit. Such development inhibitors useful in the invention are disclosed in U.S. Pat. No. 5,151,343, incorporated herein by reference. Mercaptotetrazole and mercaptooxadiazole inhibitors are especially preferred.

Linking or timing groups, when present, are groups such as esters, carbamates, and the like that undergo base-catalyzed cleavage, including anchimerically assisted hydrolysis or intramolecular nucleophilic displacement. Suitable linking groups, which are also known as timing groups, are shown in the previously mentioned U.S. Pat. No. 5,151,343 and in U.S. Pat. Nos. 4,857,447, 5,021,322, 5,026,628, and the previously mentioned U.S. Pat. No. 5,051,345, all incorporated herein by reference. Preferred linking groups are p-hydroxymethylene moieties, as illustrated in the previously mentioned U.S. Pat. No. 5,151,343 and in Coupler DIR-1 of the instant application, and o-hydroxyphenyl substituted carbamate groups.

CAR groups includes couplers which react with oxidized color developer to form dyes while simultaneously releasing development inhibitors or inhibitor precursors. Other suitable carrier groups include hydroquinones, catechols, aminophenols, aminonaphthols, sulfonamidophenols, pyrogallols, sulfonamidonaphthols, and hydrazides that undergo cross-oxidation by oxidized color developers. DIR compounds with carriers of these types are disclosed in U.S. Pat. No. 4,791,049, incorporated herein by reference. Preferred CAR groups are couplers that yield unballasted dyes which are removed from the photographic element during processing, such as those disclosed in the previously mentioned U.S. Pat. No. 5,151,343. Further, preferred carrier groups are couplers that yield ballasted dyes which match spectral absorption characteristics of the image dye and couplers that form colorless products.

In one embodiment of the invention, a three-color reversal element has the following schematic structure:

(13) Second protective layer containing matte
(12) First protective layer containing UV-absorbing dyes
(11) Fast blue-sensitive layer containing blue-sensitive emulsion and yellow coupler
(10) Slow blue-sensitive layer containing blue-sensitive emulsion and yellow coupler
(9) Yellow filter layer
(8) Intermediate layer
(7) Fast green-sensitive layer containing green-sensitive emulsion and magenta coupler
(6) Slow green-sensitive layer containing green-sensitive emulsion and magenta coupler
(5) Intermediate layer
(4) Fast red-sensitive layer containing red-sensitive emulsion and cyan coupler
(3) Slow red-sensitive layer containing red-sensitive emulsion and cyan coupler
(2) Intermediate layer
(1) Antihalation layer
Support with subbing layer In the following discussion of suitable materials for use in the emulsions and elements of this invention, reference will be made to *Research Disclosure,* December, 1989, Item 308119, published by Kenneth Mason Publications, Ltd., Dudley Annex, 12a North Street, Emsworth, Hampshire, P010 7DQ, UK, the disclosures of which are incorporated herein by reference. This publication will be identified hereafter by the term *Research Disclosure.*

Couplers which form cyan dyes upon reaction with oxidized color-developing agents are described in such representative patents and publications as U.S. Pat. Nos. 2,772,162; 2,895,826; 3,002,836; 3,034,892; 2,747,293; 2,423,730; 2,367,531; 3,041,236; and 4,333,999; and Research Disclosure, Section VII D. Preferably, such couplers are phenols and naphthols.

Couplers which form magenta dyes upon reaction with oxidized color developing agents are described in such representative patents and publications as: U.S. Pat. Nos. 2,600,788; 2,369,489; 2,343,703; 2,311,082; 3,152,896; 3,519,429; 3,062,653; and 2,908,573; and *Research Disclosure,* Section VII D. Preferably, such couplers are pyrazolones and pyrazolotriazoles.

Couplers which form yellow dyes upon reaction with oxidized and color developing agents are described in such representative patents and publications as: U.S. Pat. Nos. 2,875,057; 2,407,210; 3,265,506; 2,298,443; 3,048,194; and 3,447,928; and *Research Disclosures,* Section VII D. Preferably, such couplers are acylacetamides such as benzoylacetanilides and pivaloylacetanilides.

Couplers which form colorless products upon reaction with oxidized color developing agents are described in such representative patents as: UK Patent No. 861,138; U.S. Pat. Nos. 3,632,345; 3,928,041; 3,958,993; and 3,961,959. Preferably, such couplers are cyclic carbonyl-containing compounds which react with oxidized color developing agents but do not form dyes.

The image dye-forming couplers can be incorporated in photographic elements and/or in photographic processing solutions, such as developer solutions, so that upon development of an exposed photographic element they will be in reactive association with oxidized color-developing agent. Coupler compounds incorporated in photographic processing solutions should be of such molecular size and configuration that they will diffuse through photographic layers with the processing solution. When incorporated in a photographic element, as a general rule, the image dye-forming couplers should be nondiffusible; that is, they should be of such molecular size and configuration that they will not significantly wander from the layer in which they are coated.

Photographic elements of this invention can be processed by conventional techniques in which color-forming couplers and color-developing agents are incorporated in separate processing solutions or compositions or in the element, as described in *Research Disclosure,* Section XIX.

The DIR compounds of the invention are highly desirable because they generate more interimage at higher densities than lower densities. That is, the DIR compounds of the invention have the effect of reproducing certain colors or high relative chroma, e.g. reds, while enabling reproduction of related colors, e.g. flesh colors, with less relative increase in saturation or chroma when used in a color image forming layer or in a non-color image forming layer.

Preferred INH groups of the invention can be selected from the group having the following structures:

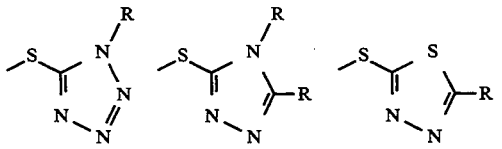

-continued

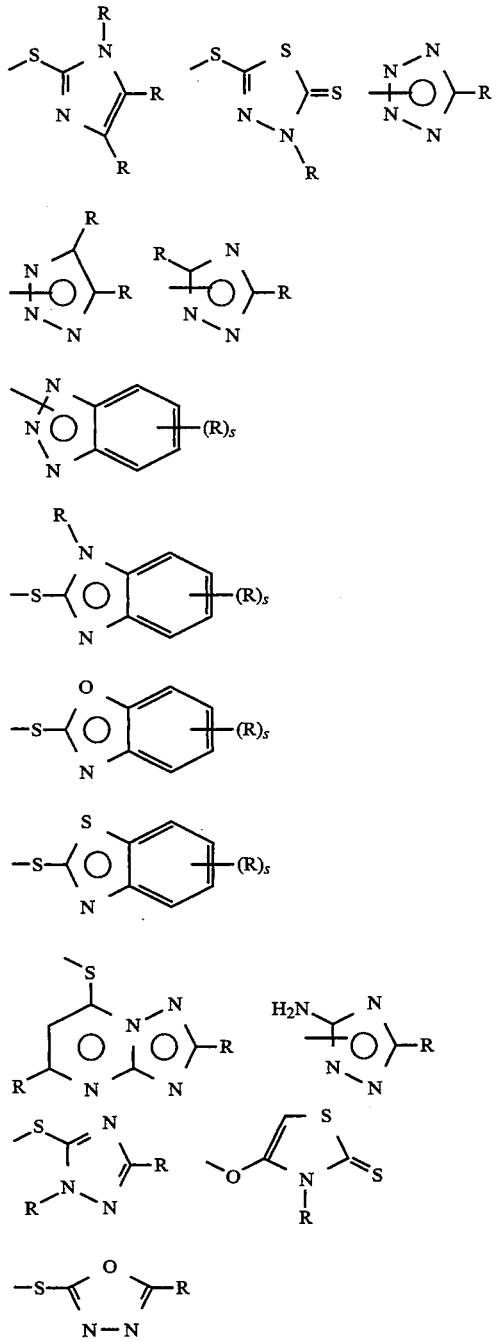

wherein R is an alkyl group, hydrogen, halogen (including fluorine, chlorine, bromine and iodine), an aryl group, or a 5- or 6-membered heterocyclic ring, alkoxy group, aryloxy group, alkoxycarbonyl group, aryloxycarbonyl group, amino group, sulfamoyl group, sulfonamido group, sulfoxyl group carbamoyl group, alkylsulfo group, arylsulfo group, hydroxy group, aryloxycarbonylamino group, alkoxycarbonylamino group, acylamino group, ureido group, arylthio group, alkylthio group, cyano group. When R is an alkyl group, the alkyl group may be substituted or unsubstituted or straight or branched chain or cyclic. The total number of carbons in R is 0 to 25. The alkyl group may in turn be substituted by the same groups listed for R. The R group may also contain from 1 to 5 thioether moieties in each of which the sulfur atom is directly bonded to a saturated carbon atom. When the R group is an aryl group, the aryl group may be substituted by the same groups listed for R. When R is a heterocyclic group, the heterocyclic group is a 5- or 6-membered monocyclic or condensed ring containing as a heteroatom a nitrogen atom, oxygen atom, or a sulfur atom. Examples are a pyridyl group, a quinolyl group, a furyl group, a benzothiazolyl group, an oxazolyl group, an imidazolyl group, a thiazolyl group, a triazolyl group, a benzotriazolyl group, an imido group and an oxazine group. When there is one or more R groups on a molecule R may be the same of different. and s is 1 to 4.

Further preferred INH groups are selected from the following the structures:

INH-1

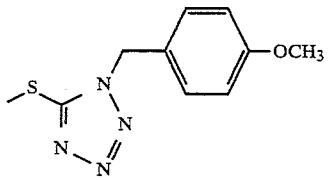

INH-2

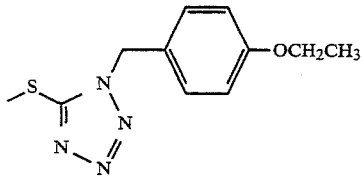

INH-3

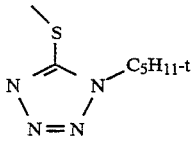

INH-4

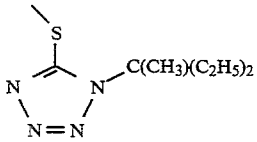

INH-5

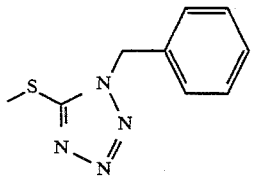

INH-6

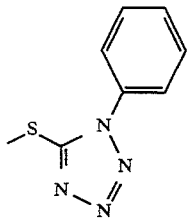

INH-7

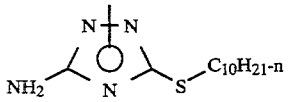

-continued

INH-8

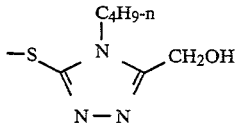

INH-9

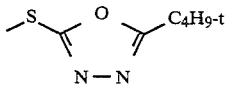

INH-10

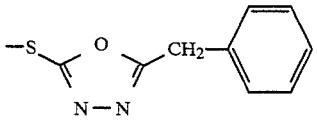

INH-11

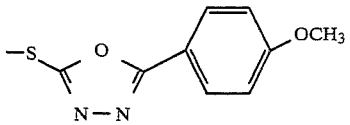

INH-12

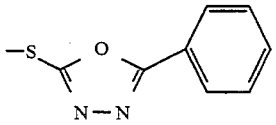

INH-13

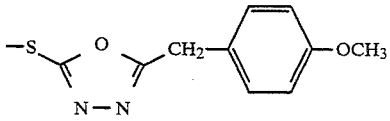

INH-14

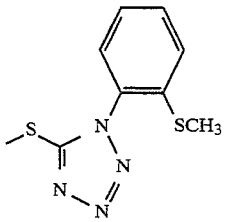

INH-15

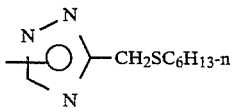

INH-16

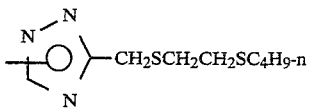

INH-17

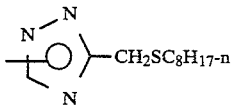

INH-18

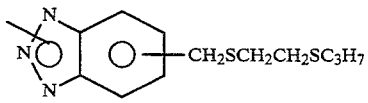

INH-19

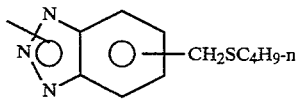

-continued

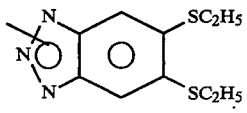

INH-20

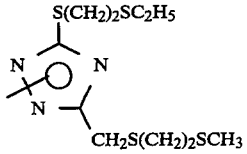

INH-21

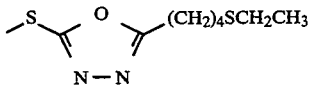

INH-22

Preferably CAR is a coupler moiety and further the coupler moiety may be ballasted.

In the element in accordance with the invention the —(TIME)$_n$—INH group is bonded to a coupling position of the coupler moiety.

Preferably CAR is unballasted and at least one TIME moiety attached to CAR is ballasted and CAR is preferably a coupler moiety.

Further, preferably CAR is a moiety which can cross-oxidize with oxidized color developer, and may be selected from the class consisting of hydrazides and hydroquinones.

The compound (I) may be present in the element from 0.5 to about 30 mg/ft$^2$ (0.005 to 0.3 g/m$^2$)and typically is present in the element from about 1 to about 10 mg/ft$^2$ (0.01 to 0.1 g/m$^2$).

CAR can, for example, be a coupler residue, designated COUP, which forms a dye as a part of a coupling reaction, or an organic residue which forms no dye. The purpose of CAR is to furnish, as a function of color development, a fragment INH, or INH linked to a linking group or timing group or to a combination of linking and timing groups, designated —(TIME)$_n$—. So long as it performs that function in an efficient manner, it has accomplished its purpose for this invention. It will be noted that when a highly active CAR is used the INH strength can be less than 1 (one) because the reactivity of the active CAR is sufficient to release the INH at an early time of development to provide interimage and sharpness effects of the invention.

When COUP is a yellow coupler residue, coupler residues having general formulas II–IV are preferred. When COUP is a magenta coupler residue, it is preferred that COUP have formula (V) or (VIII). When COUP is a cyan coupler residue, it is preferred that COUP have the formula represented by general formulas (VI) and (VII).

Furthermore, CAR may be a redox residue, which is a group capable of being cross oxidized with an oxidation product of a developing agent. Such carriers may be hydroquinones, catechols, pyrogallols, aminonaphthols, aminophenols, naphthohydroquinones, sulfonamidophenols, hydrazides, and the like. Compounds with carriers of these types are disclosed in U.S. Pat. No. 4,791,049. Preferred CAR fragments of this type are represented by general formulas (X) and (XI). The amino groups included therein are preferably substituted with $R_{10}$ which is a sulfonyl group having one to 25 carbon atoms, or an acyl group having 1–25 carbon atoms; the alkyl moieties in these groups can be substituted. Compounds within formulas (IX) and (XII) are compounds that react with oxidized developer to form a colorless product or a dye which decolorizes by further reaction.

So long as the color reversal film has an image modifying compound of the type described herein, in one image forming layer, the film is as described for this invention. It is to be understood, however, that the film may have two or more described image modifying compounds in an image forming silver halide emulsion layer, or that two or more such layers may have one or more described image modifying compounds.

In general compound (I) is represented by, for example, the following structures:

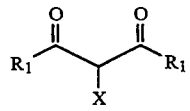

II

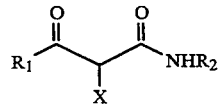

III

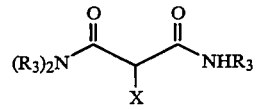

IV

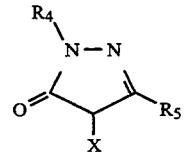

V

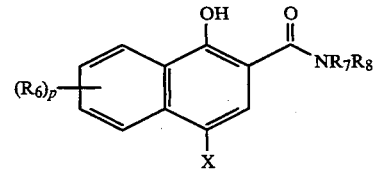

VI

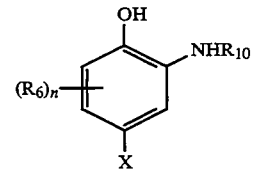

VII

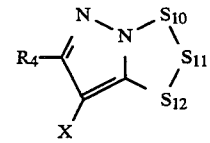

VIII

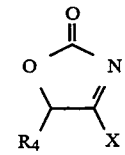

IX

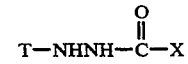

X

-continued

XI

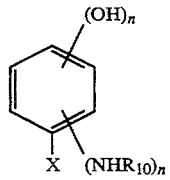

XII

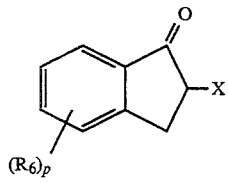

In the foregoing compounds, X=—(TIME)$_n$—INH, and $R_1$ represents an aliphatic group, an aromatic group, an alkoxy group, or a heterocyclic ring, and $R_2$ and $R_3$ are each an aromatic group, an aliphatic group or a heterocyclic ring. The aliphatic group represented by $R_1$ preferably contains from 1 to 30 carbon atoms, and may be substituted or unsubstituted, straight or branched chain, or cyclic. Preferred substituents for an alkyl group include an alkoxy group, an aryloxy group, an amino group, an acylamino group, and a halogen atom. These substituents per se may be substituted. Suitable examples of aliphatic groups represented by $R_1$, $R_2$ and $R_3$ are as follows: an isopropyl group, an isobutyl group a tert-butyl group, an isoamyl group, a tert-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an α-(diethylamino)isopropyl group, an α-(succinimido)isopropyl group, an α-(phthalimido)-isopropyl group, and an α-(benzenesulfonamido)isopropyl group. When two $R_1$ or $R_3$ groups appear, they may be alike or different.

When $R_1$, $R_2$ or $R_3$ represents an aromatic group (particularly a phenyl group), the aromatic group may be substituted or unsubstituted. That is, the phenyl group can be employed per se or may be substituted by a group containing 32 or less carbon atoms, e.g., an alkyl group, an alkenyl group, an alkoxy group, an alkoxycarbonyl group, an alkoxycarbonylamino group, an aliphatic amido group, an alkylsulfamoyl group, an alkylsulfonamido group, an acylureido group, and an alkyl-substituted succinimido group. This alkyl group may contain an aromatic group, e.g., phenylene, in the chain thereof. The phenyl group may also be substituted by, e.g., an aryloxy group, an aryloxycarbonyl group, an arylcarbamoyl group, an arylamido group, an arylsulfamoyl group, an arylsulfonamido group, or an arylureido group. In these subtituents, the aryl group portion may be further substituted by at least one alkyl group containing from 1 to 22 carbon atoms in total.

The phenyl group represented by $R_1$, $R_2$, or $R_3$ may be substituted by an amino group which may be further substituted by a lower alkyl group containing from 1 to 6 carbon atoms, a hydroxyl group, a carboxyl group, a sulfo group, a nitro group, a cyano group, a thiocyano group, or a halogen atom.

In addition, $R_1$, $R_2$ or $R_3$ may further represent a substituent resulting from condensation of a phenyl group with another ring, e.g., a naphthyl group, a quinolyl group, an isoquinolyl group, a furanyl group, a cumaranyl group, and a tetrahydronaphthyl group. These substituents per se may be further substituted.

When $R_1$ represents an alkoxy group, the alkyl portion of the alkoxy group contains from 1 to 40 carbon atoms and preferably from 1 to 22 carbon atoms, and is a straight or branched alkyl group, a straight or branched alkenyl group, a cyclic alkyl group, or a cyclic alkenyl group. These groups may be substituted by, e.g., a halogen atom, an aryl group or an alkoxy group.

When $R_1$, $R_2$ or $R_3$ represents a heterocyclic ring, the heterocyclic ring is bound through one of the carbon atoms in the ring to the carbon atom of the carbonyl group of the acyl group in α-acylacetamide, or to the nitrogen atom of the amido group in α-acylacetamide. Examples of such heterocyclic rings are thiophene, furan, pyran, pyrrole, pyrazole, pyridine, piperidine, pyrimidine, pyridazine, indolizine, imidazole, thiazole, oxazole, triazine, thiazine and oxazine. These heterocyclic rings may have a substituent on the ring thereof.

In structure (V), $R_4$ contains from 1 to 40 carbon atoms, preferably from 1 to 30 carbon atoms, and is a straight or branched alkyl group (e.g., methyl, isopropyl, tert-butyl, hexyl and dodecyl), an alkenyl group (e.g., an allyl group), a cyclic alkyl group (e.g., a cyclopentyl group, a cyclohexyl group and a norbornyl group), an aralkyl group (e.g., a benzyl group and a β-phenylethyl group), or a cyclic alkenyl group (e.g., a cyclopentenyl group and a cyclohexenyl group). These groups may be substituted by, e.g., a halogen atom, a nitro group, a cyano group, an aryl group, an alkoxy group, an aryloxy group, a carboxyl group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxyl group and a mercapto group.

$R_4$ may further represent an aryl group, e.g. a phenyl group, and an α- or β-naphthyl group. This aryl group contains at least one substituent. These substituents include an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxyl group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxyl group and a mercapto group.

More preferably, $R_4$, is a phenyl group which is substituted by, e.g., an alkyl group, an alkoxy group or a halogen atom, in at least one of the ortho positions.

$R_4$ may further represent a heterocyclic ring (e.g., 5- or 6-membered heterocyclic or condensed heterocyclic group containing a nitrogen atom, an oxygen atom or a sulfur atom as a hetero atom, such as a pyridyl group, a quinolyl group, a furyl group, a benzothiazolyl group, an oxazolyl group, an imidazolyl group and a naphthoxazolyl group), a heterocyclic ring substituted by the groups described for the aryl group as described above, an aliphatic or aromatic acyl group, an alkylsulfonyl group, an arylsulfonyl group, an alkylcarbamoyl group, an arylcarbamoyl group, an alkylthiocarbamoyl group or an arylthiocarbamoyl group.

$R_5$ is a hydrogen atom, a straight or branched alkyl group containing from 1 to 40 carbon atoms, preferably from 1 to 30 carbon atoms, an alkenyl group, a cyclic alkyl group, an aralkyl group, a cyclic alkenyl group to which may contain substituents as described for $R_4$), an aryl group and a heterocyclic group (which may contain substituents as described for $R_4$,), an alkoxycarbonyl group (e.g., a methoxycarbonyl group, an ethoxycarbonyl group and a stearyloxycarbonyl group), an aryloxycarbonyl group (e.g., a phenoxycarbonyl group, and a naphthoxycarbonyl group), an aralkyloxycarbonyl group (e.g., a benzyloxycarbonyl group), an alkoxy group (e.g., a methoxy group, an ethoxy group and a heptadecyloxy group), an aryloxy group (e.g., a phenoxy group and a tolyloxy group), an alkylthio group (e.g., an ethylthio group, and a dodecylthio group), an arylthio group (e.g., a phenylthio group and an α-naphthylthio group), a carboxyl group, an acylamino group (e.g., an acetylamino group and a 3-[(2,4-di-tertamylphenoxy)acetamido]benzamido group), a diacylamino group, an N-alkylacylamino group (e.g., an N-methylproprionamido group), an N-arylacylamino group (e.g., an N-phenylacetamido group), a ureido group (e.g. a ureido group and an N-arylureido group), a urethane group, a thiourethane group, an arylamino group (e.g., a phenylamino group, an N-methylanilino group, a diphenylamino group, an N-acetylanilino group and a 2-chloro-5-tetradecanamidoanilino group), a dialkylamino group (e.g., a dibenzylamino group), an alkylamino group (e.g., an n-butylamino group, a methylamino group and a cyclohexylamino group), a cycloamino group (e.g., a piperidino group and a pyrrolidino group), a heterocyclic amino group (e.g., a 4-piperidylamino group and a 2-benzoxazolylamino group), an alkylcarbonyl group (e.g., a methylcarbonyl group), an arylcarbonyl group (e.g., a phenylcarbonyl group), a sulfonamido group (e.g., an alkylsulfonamido group, and an arylsulfonamido group), a carbamoyl group (e.g., an ethylcarbamoyl group, a dimethylcarbamoyl group, an N-methylphenylcarbamoyl group, and an N-phenylcarbamoyl group), a 4,4'-sulfonyldiphenoxy group, a sulfamoyl group (e.g., an N-alkylsulfamoyl group, an N,N-dialkylsulfamoyl group, an N-arylsulfamoyl group, an N-alkyl-N-arylsulfamoyl group and an N,N-diarylsulfamoyl group), a cyano group, a hydroxyl group, a mercapto group, a halogen atom or a sulfo group.

$R_6$, $R_7$ and $R_8$ each represents groups as used for the usual 4-equivalent type phenol or α-naphthol couplers. In greater detail, $R_6$ is a hydrogen atom, a halogen atom, an aliphatic hydrocarbon residue, an acylamino group, —O—$R_9$ or —S—$R_9$ (wherein $R_9$ is an aliphatic hydrocarbon residue). When there are two or more $R_6$ groups in the same molecule, they may be different. The aliphatic hydrocarbon residue includes those containing a substituent(s). $R_7$ and $R_8$ are each an aliphatic hydrocarbon residue, an aryl group or a heterocyclic residue. One of $R_7$ and $R_8$ may be a hydrogen atom, and the above-described groups for $R_7$ and $R_8$ may be substituted. $R_7$ and $R_8$ may combine together to form a nitrogen-containing heterocyclic nucleus. In the formulas, n is an integer of from 1 to 3, and p is an integer of from 1 to 5.

$R_{11}$ group refers to a hydrogen atom, a halogen atom, an alkyl group, an alkenyl group, an aralkyl group, an alkoxy group, an alkoxycarbonyl group, an anilino group, an acylamino group, a ureido group, a cyano group, a nitro group, a sulfonamido group, a sulfamoyl group, a carbamoyl group, an aryl group, a carboxy group, a sulfo group, a hydroxy group, or an alkanosulfonyl group. The alkyl group on $R_{11}$ contains 1 to 32 carbons. In the general formulae X–XXII, Z is oxygen, nitrogen, or sulfur, and k is an integer of 0 to 2.

$R_{10}$ is an acylamido group represented by $COR_1$, a carbamoyl group represented by $CONHR_7RS$, a sulfonamido group represented by $SO_2R_1$, or a $SO_2NR_7R_8$.

The aliphatic hydrocarbon residue may be saturated or unsaturated, straight, branched or cyclic. Preferred examples are an alkyl group (e.g., a methyl group, an ethyl group, a propyl group, an isopropyl group, a butyl group, a tert-butyl group, an isobutyl group, a dodecyl group, an octadecyl group, a cyclobutyl group, and a cyclohexyl group), and an alkenyl group (e.g., an allyl group, and an octenyl group).

The aryl group includes a phenyl group and a naphthyl group, and typical examples of heterocyclic residues are a pyridinyl group, a quinolyl group, a thienyl group, a piperidyl group and an imidazolyl group. Substituents which may be introduced to these aliphatic hydrocarbon, aryl, and heterocyclic groups include a halogen atom, a nitro group, a hydroxyl group, a carboxyl group, an amino group, a substituted amino group, a sulfo group, an alkyl group, an alkenyl group, an aryl group, a heterocyclic group, an alkoxy group, an aryloxy group, an arylthio group, an arylazo group, an acylamino group, a carbamoyl group, an ester group, an acyl group, an acyloxy group, a sulfonamido group, a sulfamoyl group, a sulfonyl group and a morpholino group.

In compounds (II) to (XXII), the substituents, $R_1$, $R_2$, $R_3$, $R_4$, $R_5$, $R_6$, $R_7$ and $R_8$ may combine together to form symmetrical or asymmetrical composite couplers, or any of the substituents may become a divalent group to form symmetrical or asymmetrical composite couplers.

In compounds VIII: $S_{10}$, $S_{11}$ and $S_{12}$ each represents a methine, a substituted methine, =N—, or —NH—; one of $S_{10}$–$S_{11}$ bond and $S_{11}$–$S_{12}$ bond is a double bond and the other is a single bond; when $S_{11}$–$S_{12}$ is a carbon-carbon double bond, the double bond may be a part of an aromatic ring; the compound of general formula VIII includes the case that it forms a dimer or higher polymer at $R_4$; and also when $S_{10}$, $S_{11}$ or $S_{12}$ is a substituted methine, the compound includes the case that it forms a dimer or higher polymer with the substituted methine. Polymer formation can also take place through the linking group —$(TIME)_n$— in all image modifying compounds employed in this invention.

If $R_1$ through $R_{10}$ of structures II through VIII are a ballast such that the dye which is formed on reaction with oxidized developer remains in the film after processing then the formulae are represented by Type II examples.

Especially preferred are those couplers which undergo a coupling reaction with an oxidation product of a developing agent, releasing a development inhibitor, but do not leave a dye in the film which could cause degradation of the color quality. If $R_1$ through $R_{10}$ of compounds II through VIII are not a ballast such that the subsequent dye formed from CAR is not immobilized, and is removed from the film during processing, then the formulae are represented by Type I examples. Also included in these Type I examples are formulae IX, X, XI and XII in which $R_1$ through $R_8$ do represent a ballast, but CAR either forms a colorless product or doesn't form a dye on reaction with oxidized developer (as in the case with compounds XI and XII) or the dye that is formed is decolorized by subsequent reactions in the process (as is the case with compounds IX and XII).

Also preferred structures which would produce the same effects as DIR couplers without leaving a retained dye in the film are those in which CAR is a material capable of undergoing a redox reaction with the oxidized product of a developing agent and subsequently releasing a development inhibitor as described in U.S. Pat. No. 4,684,604 and represented by the compound X where T represents a substituted aryl group. T may be represented by phenyl, naphthyl; and heterocyclic aryl rings (e.g. pyridyl) and may be substituted by one or more groups such as alkoxy, alkyl, aryl, halogen, and those groups described as $R_5$.

$R_{10}$ is selected from alkyl or aryl sulfonyl groups and alkyl and aryl carbonyl groups In the compounds (I), —(TIME)$_n$—INH is a group which is not released until after reaction with the oxidized developing agent either through cross oxidization or dye formation.

—(TIME)$_n$— in the compounds (I) is one or more linking or timing groups connected to CAR through a oxygen atom, a nitrogen atom, or a sulfur atom which is capable of releasing INH from —(TIME)$_n$—INH at the time of development through one or more reaction stages. Suitable examples of these types of groups are found in U.S. Pat. Nos. 4,248,962, 4,409,323, 4,146,396, British Pat. No. 2,096,783, Japanese Patent Application (Opi) Nos. 146828/76 and 56837/82, etc.

Preferred examples of —(TIME)— are those represented by the following examples XIII–XX:

XIII

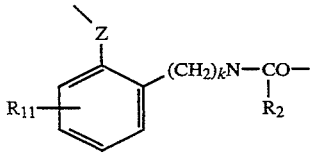

XIV

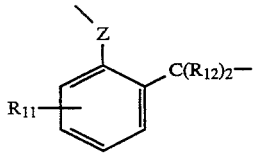

XV

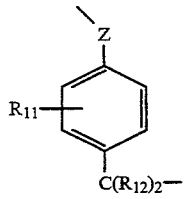

-continued

XVI

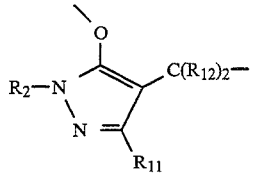

XVII

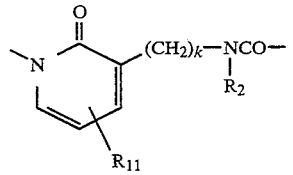

XVIII

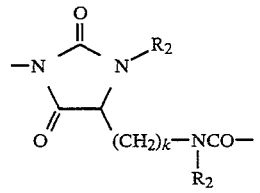

XIX

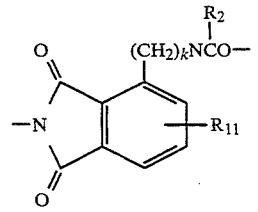

XX

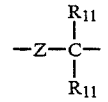

In each of the foregoing compounds, the bond on the left is attached to either CAR or another —(TIME)— moiety, and the bond to the right is attached to INH.

$R_{12}$ is hydrogen, alkyl, perfluoroalkyl, alkoxy, alkylthio, aryl, aryloxy, arylthio, $(R_2)_2N$—, $R_1CONR_7$—, or heterocyclic; $(R_{12})_2$ can complete a non-aromatic heterocyclic or a non-aromatic carbocyclic ring, and $R_{12}$ and $R_{11}$ can complete a non-aromatic heterocyclic or non-aromatic carbocyclic ring.

In timing groups XIII, XIV, XV, and XVII, $R_{11}$ can complete a carbocyclic or heterocyclic ring or ring system. Rings completed include derivatives of naphthalene, quinoline, and the like.

When n=0, —(TIME)$_n$— also represents a single bond such that CAR may be directly joined to INH.

For n=2, there can be a combination of any two timing groups mentioned in formulas XIII to XX which still allows the fragmentation and release of INH during color development after CAR has reacted with the oxidized developer. The combination of two timing groups may be used to improve the release of the inhibitor fragment INH either through rate of release and/or diffusability of —(TIME)$_n$—INH or any of its subsequent fragments. For example, preferred structures are:

XXI
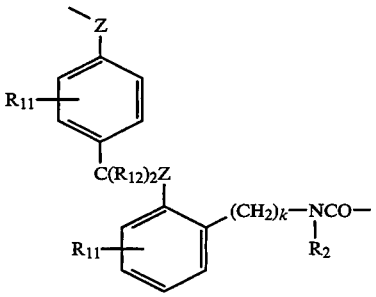
XXII
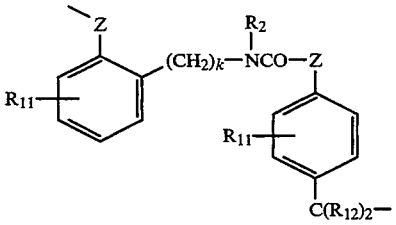
XXIII
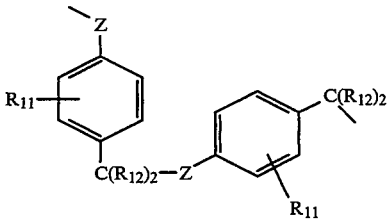
XXIV
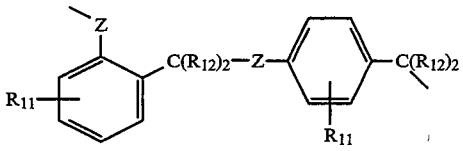
XV
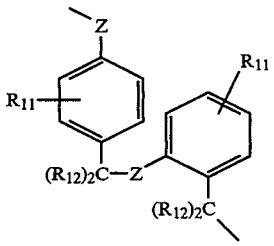
XXVI
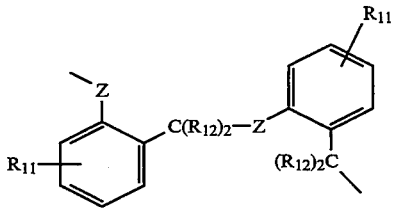
Naphtholic DIR couplers as described can be prepared by reactions and methods known in the organic compound synthesis art. Similar reactions and methods are described in U.S. Pat. No. 4,482,629. Typically, the following naphtholic coupler is prepared by the following method:
Schematic synthesis of DIR-23
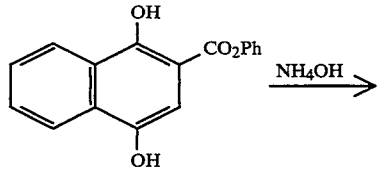
(A1)
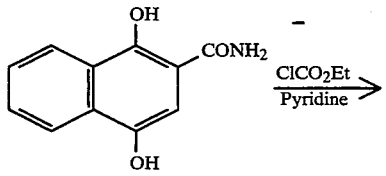
(A2)
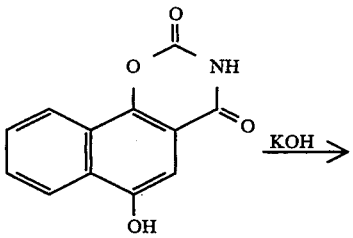
(A3)
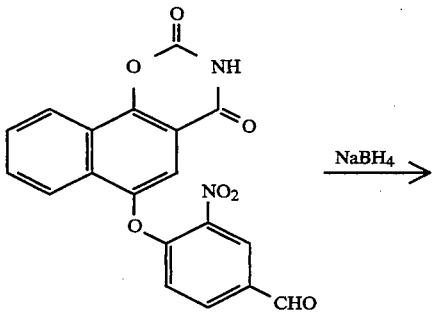
(A4)
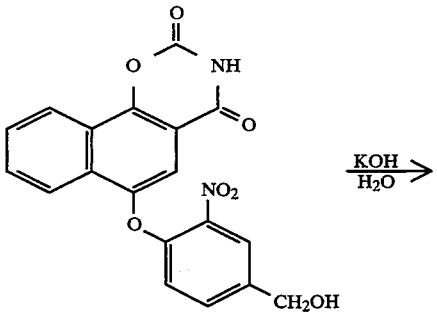
(A5)

-continued

Schematic synthesis of DIR-23

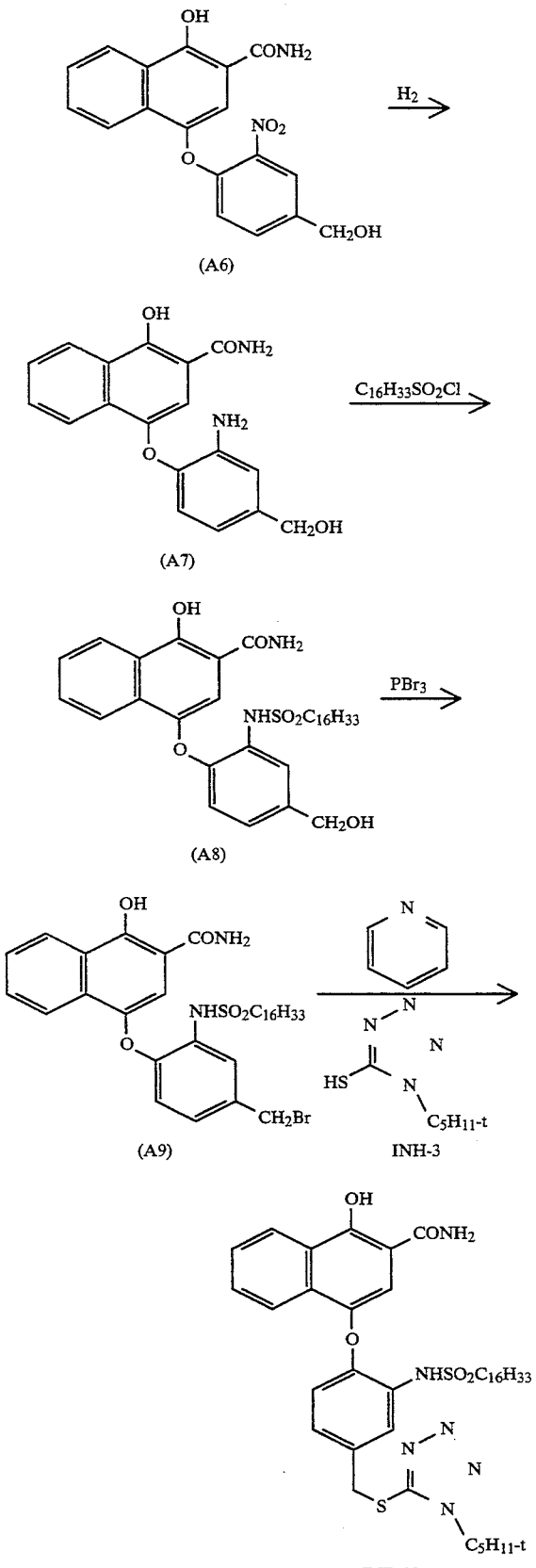

Synthesis of DIR-23

Compound (A2)

Phenyl 1,4-dihydroxy-2-naphthoate (100.0 g, 357 mmol) was dissolved in deoxygenated tetrahydrofuran (500 mL), and deoxygenated methanol (500 mL) was added. To this solution, stirred at room temperature under the nitrogen atmosphere, was added ammonium acetate (50.0 g, 649 mmol), followed by concentrated ammonium hydroxide (1.0 L). After stirring for 3 hours the reaction was then poured into ice cold 2N HCl (4.0 L), and enough concentrated HCl was added to bring the pH to 1. The resulting product, compound (A2) was filtered off, washed well with water and air dried. The crude product was washed with dichloromethane and air dried. Yield: 62.0 g (72%).

Compound (A3)

Compound (A2) (50.0 g, 0.246 mol) was dissolved in dry pyridine (150 mL), and acetonitrile (75 mL) was added. The solution was stirred and cooled to between −5° to 0° C. Ethyl chloroformate (50.0 mL, 0.523 mol) was then added dropwise with stirring while maintaining the temperature at 0° C. After the addition, the cooling bath was removed, and the temperature was allowed to reach room temperature. The reaction mixture was then gradually heated to reflux, and the solvent allowed to distill off. This procedure was continued until the temperature had risen to approximately 120° C. and 150 mL of solvent had been collected. Heating under reflux was continued for an additional 1 hour period. The reaction mixture was then cooled to approximately 50° C. and poured into 2N HCl (3.0 L) held at room temperature. The resulting suspension was then stirred for approximately 15 minutes, filtered, and the residue washed well with water, acetonitrile and, finally, ether. This gave the product, compound (A3) sufficiently pure for the next step. Yield: 43.5 g (77%)

Compound (A4)

Compound (A3) (23.0 g, 100 mmol) was taken up in deoxygenated dimethylsulphoxide (250 mL) and deoxygenated water (25 mL) added. To this solution, stirred at room temperature under nitrogen, was added 85%-potassium hydroxide (9.9 g, 150 mmol) and stirring continued until dissolution, approximately 15 minutes. 4-Chloro-3-nitrobenzaldehyde (18.6 mmol) was then added all at once and the resulting solution stirred at 60° C. for 1 hour. The reaction mixture was then poured into ice cold 2N HCl (2.0 L) and the product filtered off. The product, compound (A4), was washed with water and, while still wet, slurried in methanol, filtered and washed with ether. This product was pure enough to be used in the next step. Yield: 28.0 g (74%).

Compound (A5)

Compound (A4) (28.0 g, 74.0 mmol), in a powdered form, was suspended in tetrahydrofuran (150 mL) and methanol (100 mL). Water (100 mL) was added followed by sodium borohydride (2.80 g, 74.0 mmol) in small portions. More tetrahydrofuran (50 mL) was added to aid stirring. At the end of the sodium borohydride addition complete dissolution had been achieved. The reaction was allowed to proceed for a further 15 minutes, then poured into ice cold 2N HCl (2.0 L) and the product filtered off. The product (A5) was washed with methanol and while still wet with solvent, suspended in ethanol and heated to reflux. The solution was cooled; the product (A5) was filtered, washed with methanol and ether, and finally air dried. A second crop of material was obtained on concentrating the mother liquor. Total yield: 19.5 g (67%).

Compound (A6)

Compound (A5) (19.0 g, 50.0 mmol) was suspended in water (200 mL) containing 85% potassium hydroxide (26.3 g, 400 mmol). Methanol (50 mL) was added, and the mixture was then heated to 80° C. for 1 hour. The resulting dark yellow-brown solution was cooled and poured into ice cold 2N HCl (2.0 L). The yellow product was filtered off, washed well with water, and air dried. Yield: 17.7 g (100%).

Compound (A7)

Compound (A6) (17.7 g, 70.0 mmol) was dissolved in tetrahydrofuran (80 mL) and methanol (300 mL) added. Raney-Nickel which had been washed several times with water and then methanol was added, and the solution hydrogenated at 55 psi for 2 hours, after which hydrogen up-take had ceased. The catalyst was filtered off and washed with methanol, and the filtrate concentrated under reduced pressure to give product (A7). This product was deemed sufficiently pure to be carried on to the next step. Yield: 100%.

Compound (A8)

Compound (A7) (50.0 mmol) was dissolved in dry pyridine (150 mL), and hexadecylsulfonyl chloride (16.2 g, 50.0 mmol) added. The solution was stirred at room temperature under a nitrogen atmosphere for 30 minutes. The pyridine was concentrated under reduced pressure, and the residue taken up in ethyl acetate. This ethyl acetate solution was then washed three times with 2N HCl, dried over $MgSO_4$, filtered, and concentrated. The solvent was removed under reduced pressure, and the residual oil crystallized from acetonitrile. Yield: 16.3 g (53% calculated from compound (A5).

Compound (A9)

Compound (A8) (4.00 g, 6.53 mmol) was suspended in dry ether (30 mL), and phosphorous tribromide (0.68 mL, 7.2 mmol) in ether (20 mL) added dropwise over a 15 minute period. After the addition the reaction was diluted with ether, and the ether was solution washed once with 2N HCl and then dried over $MgSO_4$ filtered, and concentrated to give compound (A9). Yield: 100%.

Compound DIR-23

Compound (A9) (15,8 g, 25.0 mmol), 1-t-amyl 5-mercaptotetrazole (INH-3) (4.30 g, 25.0 mmol), and triethyl amine (5.57 g, 55.0 mmol) were dissolved in 85 ml anhydrous tetrahydrofuran, and the mixture stirred at room temperature overnight in a stoppered flask. The solution was poured into 10% HCl, and the product extracted into ethyl acetate. The ethyl acetate layer was washed twice with 5% $NaHCO_3$, dried over $MgSO_4$, filtered and evaporated. The resulting glass was chromatographed through 1L silica gel, eluting with 1 L methylene chloride followed by 1:9 acetonitrile: methylene chloride. The purified product was recrystallized two times from acetonitrile to give DIR-23 as a white solid, mp 94°–96 ° C. Yield: 16.4 g, 68%.

Schematic synthesis of INH-3

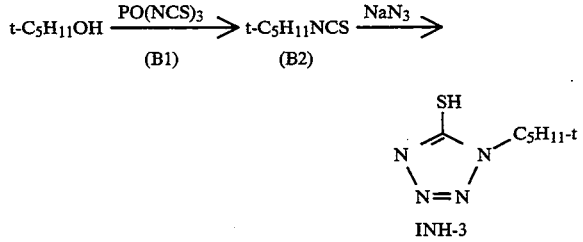

Synthesis INH-3

Compound (B1)

Phosphoryl isothiocyanate, (B1), was prepared by the method of L. Kniezo and J. Bernat, Synthetic Communications, 20(4), 509–513 (1990). Potassium thiocyanate (194 g, 2.00 mol) and 7.2 g 18-crown-6 were added to 530 ml toluene in a 1 l three-neck flask fitted with a mechanical stirrer, Dean-Stark trap, condenser, and thermometer. Under nitrogen, the stirred mixture was heated to reflux, and 75 ml toluene were removed. The mixture was allowed to cool slightly, and phosphoryl chloride (76.7 g, 0.500 mol) added dropwise. The resulting mixture was heated at 100° C. for 16 hrs. The mixture was cooled to room temperature and filtered through glass fiber filter paper, washing the solids with toluene. The filtrate was concentrated on a rotary evaporator at 30° C. to give 97.9 g (B1), a yellow liquid used without further purification. Yield: 89%.

Compound (B2)

t-Amylisothiocyanate, (B2), was prepared by the method of L. Kniezo and J. Bernat, Synthetic Communications, 20(4), 509–513 (1990). t-Amyl alcohol (39.9 g, 0.452 mol) was added to a 100 ml three-neck flask fitted with a thermometer, reflux condenser, and addition funnel. Under nitrogen phosphoryl isothiocyanate (50.0 g, 0.226 mol), compound (B1), was added slowly with stirring. The temperature rose to 40° C. The resulting solution was slowly heated until refluxing occurred at 65° C.; this disappeared after a few minutes. The solution was heated to 80° C. An exotherm occurred, and a cold water bath was applied to keep the temperature at 80° C. A viscous white precipitate developed which made stirring difficult. When the exotherm diminished some of the precipitate was removed on the end of a glass rod, and the mixture was heated at 80 C for three hours. The cooled mixture was extracted with 3×150 ml ligroin, and the organic layer filtered through glass-fiber filter paper. The filtrate was concentrated on a rotary evaporator at room temperature to give 61.0 g t-amylisothiocyanate (B2) as a light yellow oil. Distillation under house vacuum gave 35.3 g as a clear, colorless oil, b.p. 102°–103° C. Yield: 60.4 %

Compound INH-3

A solution of (B2) (32.2 g, 0.249 mol) in 150 ml ethanol was placed in a 250 ml three-neck flask fitted with a reflux condenser, thermometer, and magnetic stirring bar. A solution of $NaN_3$ (32.5 g, 0.500 mol) in 150 ml water was added, and the solution refluxed for 17 hours. The red solution was cooled to room temperature, and the now yellow solution poured into 400 ml ice-water containing 100 ml conc. HCl. The white solid was filtered and washed with water to give 36.6 g (B3), mp 100°-102° C. The product was recrystallized from 70 ml acetonitrile to give 24.9 g 4-t-amyl-5-mercapto-1,2,3,4-tetrazole, mp 104°-106.5° C. Yield: 58.0 %.

All compounds gave satisfactory 300 MHz NMR spectra and other analytical data consistent with the desired compounds.

For this invention, the image modifying compound of the type described above is present in a silver halide layer which contributes to image formation by substantial formation of a dye. It is preferred that the image modifying compound be present in an amount of from about 0.5 to about 30 mg/ft$^2$ (0.0054 to 0.323 g/m$^2$ of the reversal color material, e.g. film; more preferably, from 1 to about 10 mg/ft$^2$ (0.01 to 0,108 g/m$^2$) .

Illustrative but not limiting image modifying compounds which can be employed in this invention appear below:

DIR-1

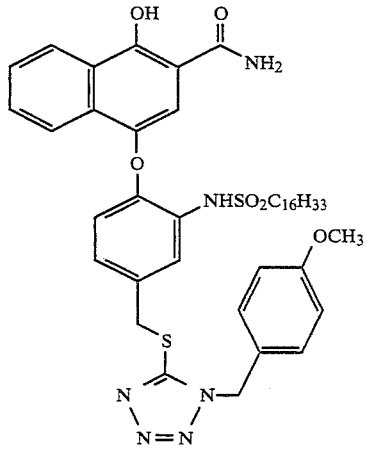

DIR-2

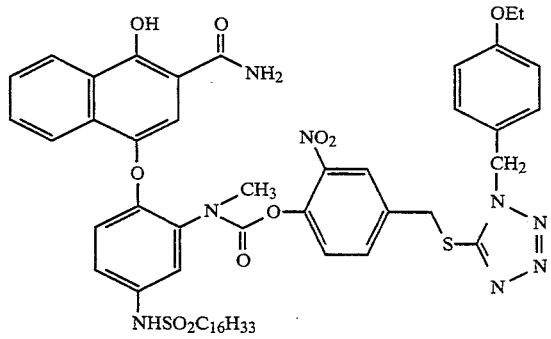

DIR-3

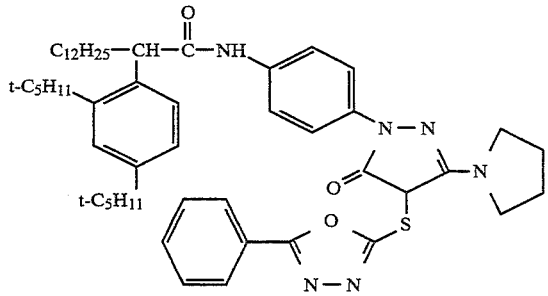

DIR-4

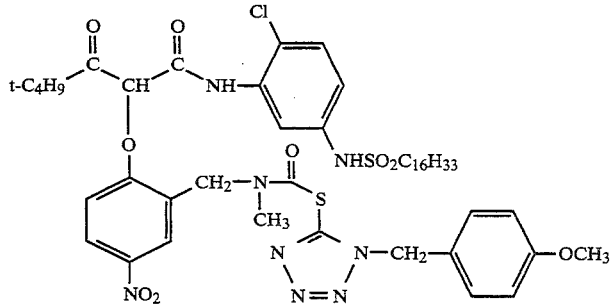

-continued
DIR-5
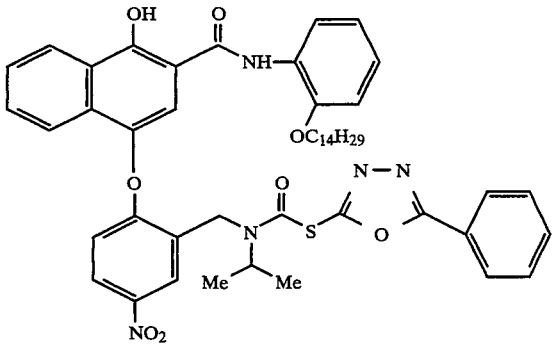
DIR-6
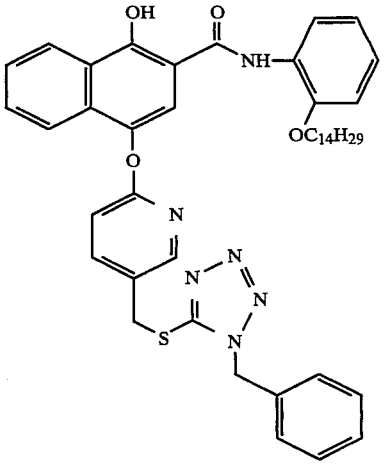
DIR-7
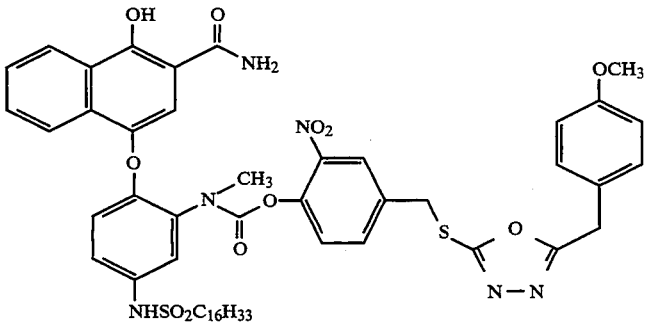
DIR-8
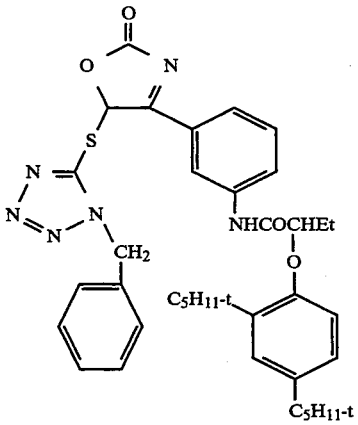

-continued
DIR-9
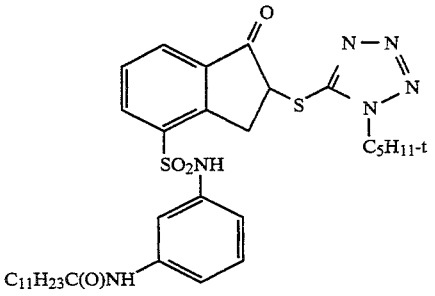
DIR-10
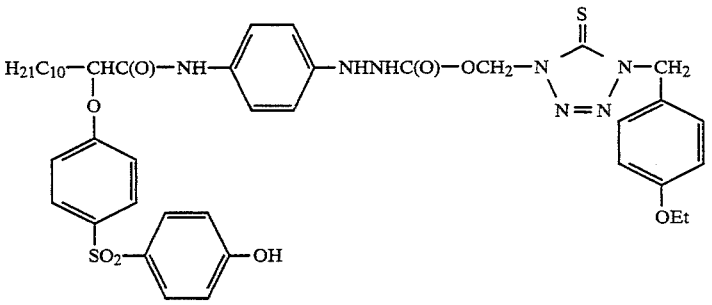
DIR-11
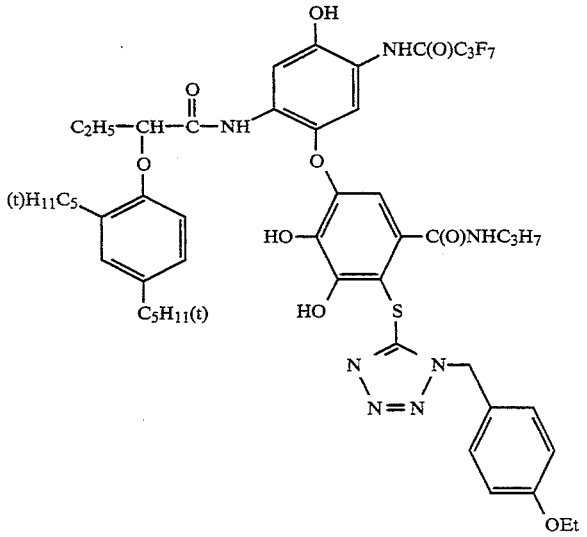
DIR-12
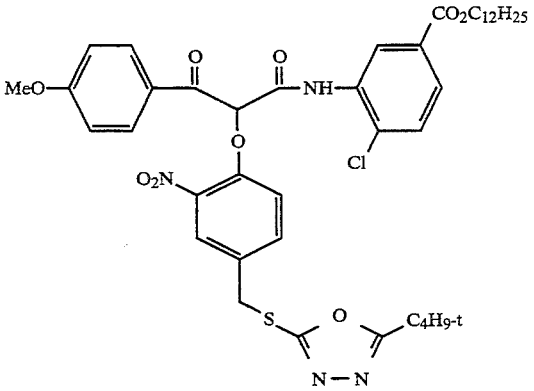

-continued
DIR-13
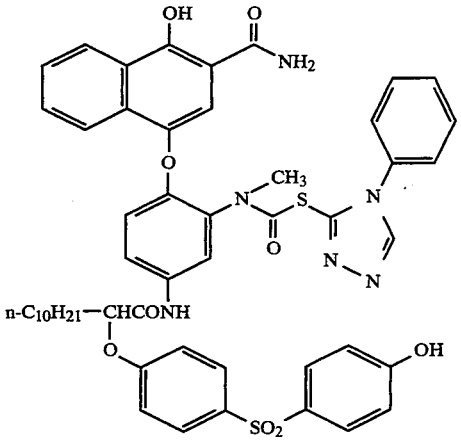
DIR-14
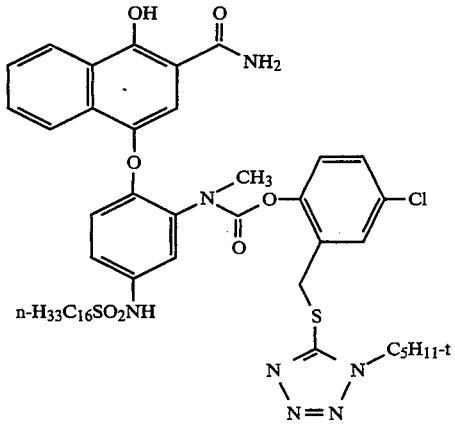
DIR-15
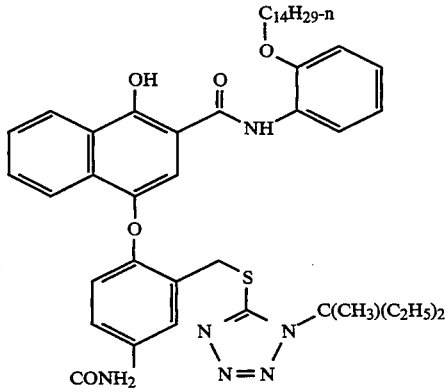
DIR-16
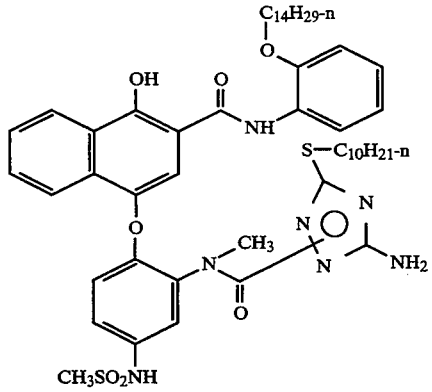

-continued
DIR-17
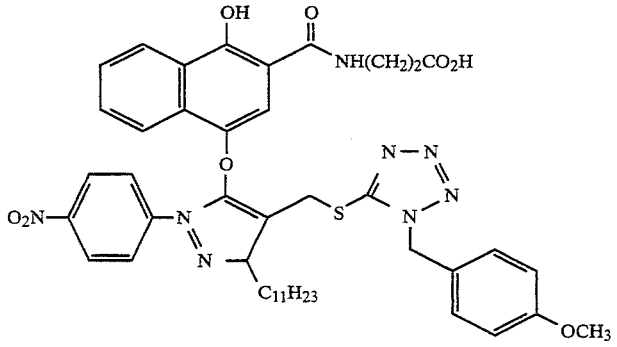
DIR-18
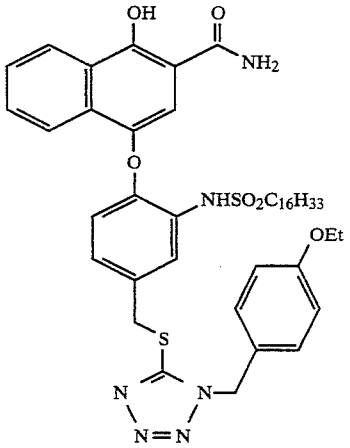
DIR-19
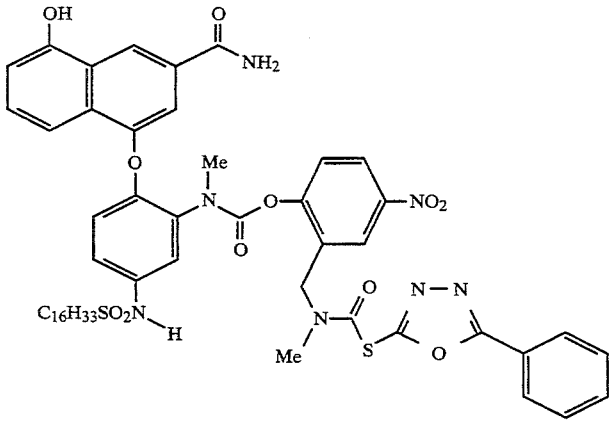
DIR-20
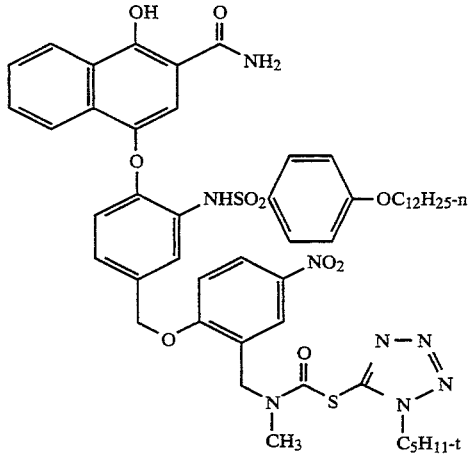

-continued
DIR-21
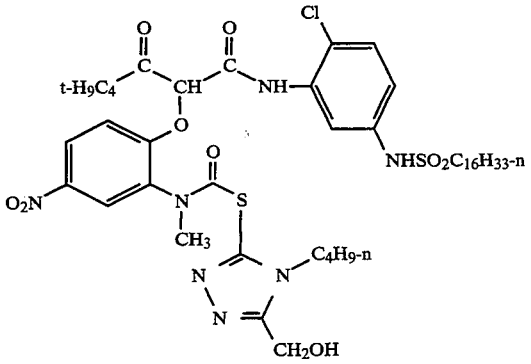
DIR-22
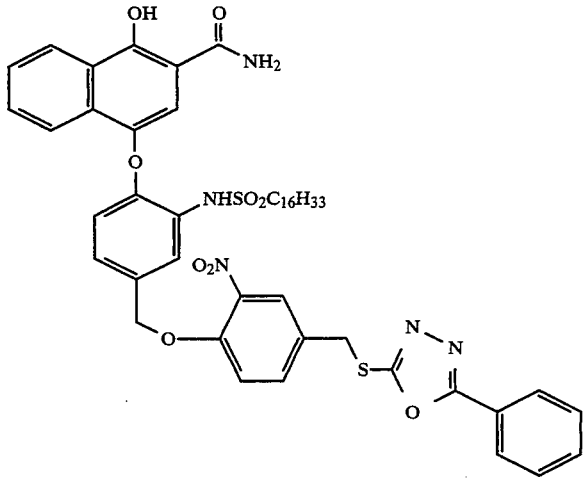
DIR-23
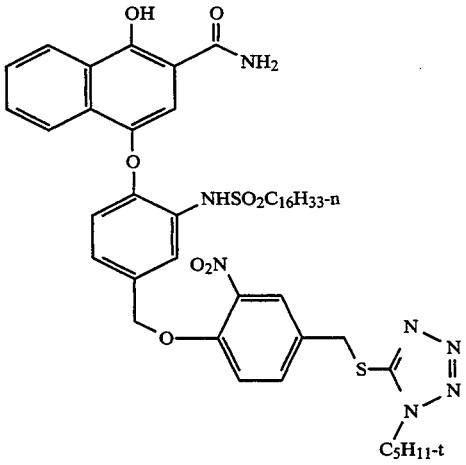
DIR-24
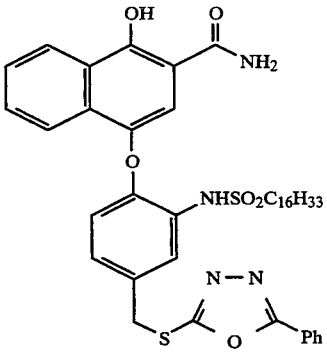

-continued
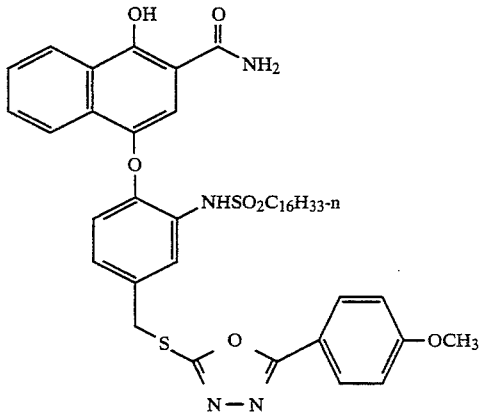
DIR-25
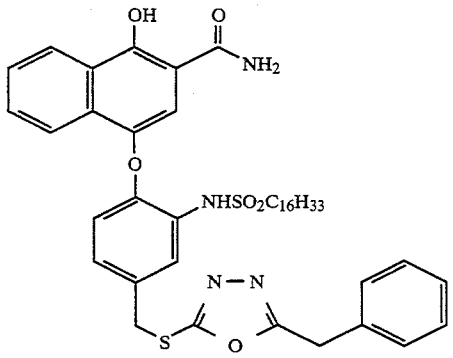
DIR-26
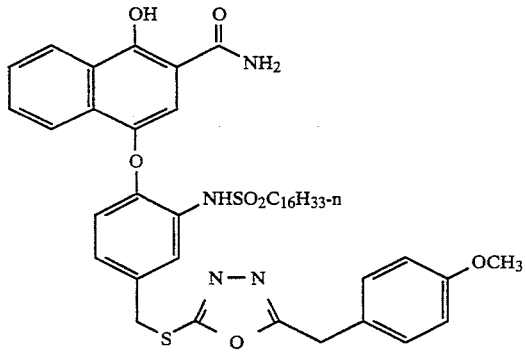
DIR-27
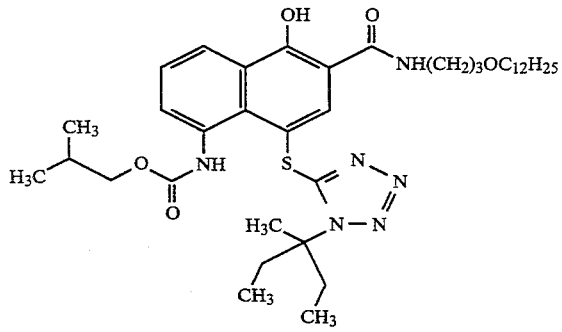
DIR-28

-continued
DIR-29
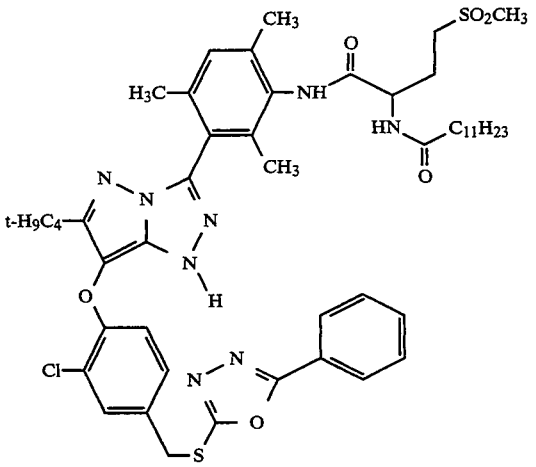
DIR-30
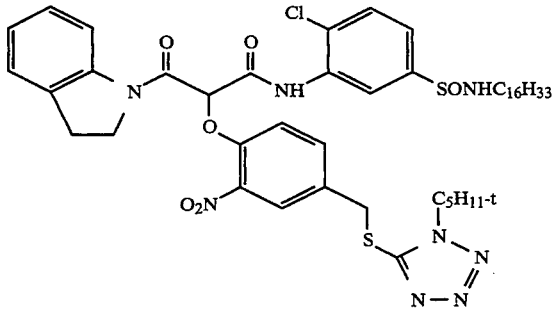
DIR-31
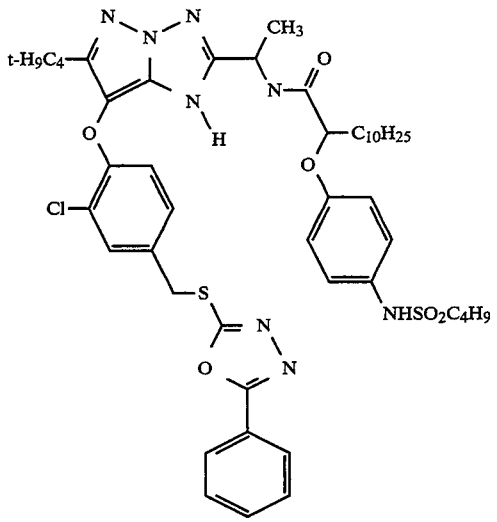
DIR-32
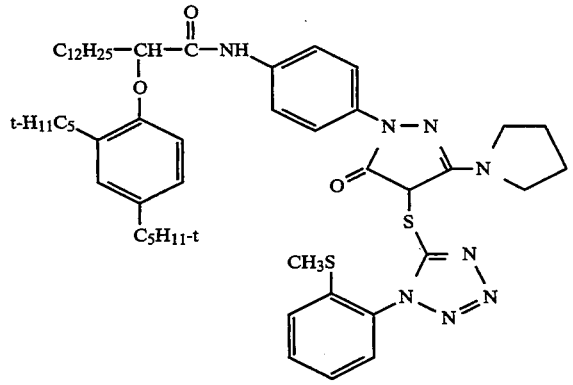

-continued
DIR-33
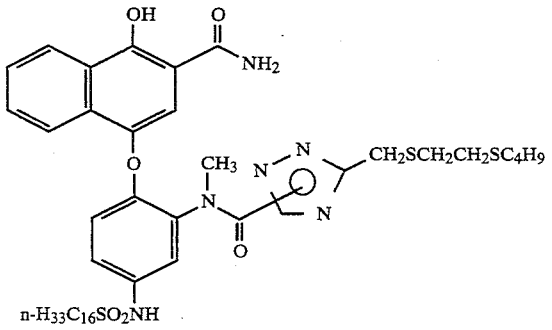
DIR-34
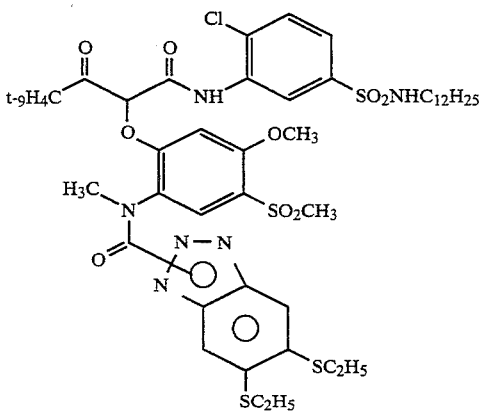
DIR-35
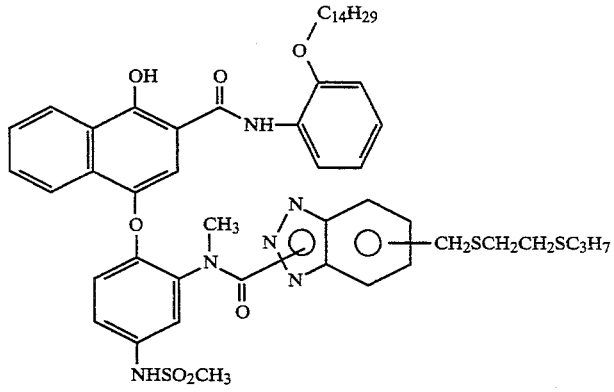

-continued
DIR-36
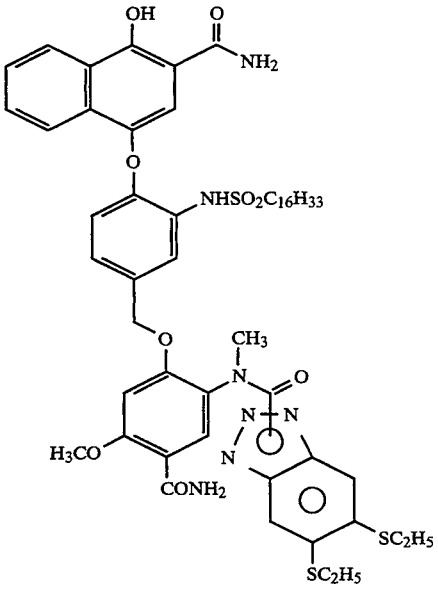
DIR-37
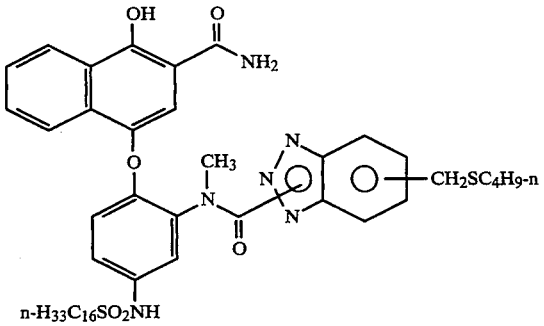
DIR-38
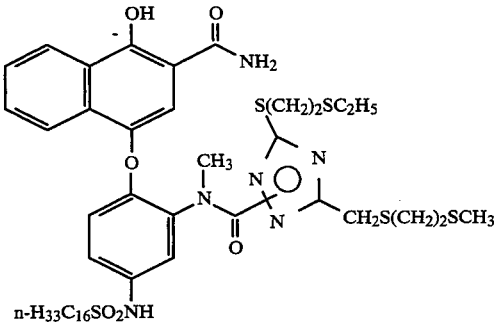
DIR-39
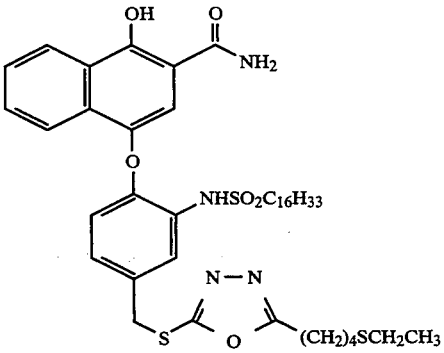

-continued

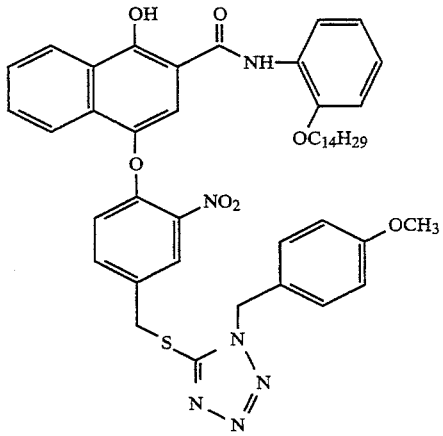

DIR-40

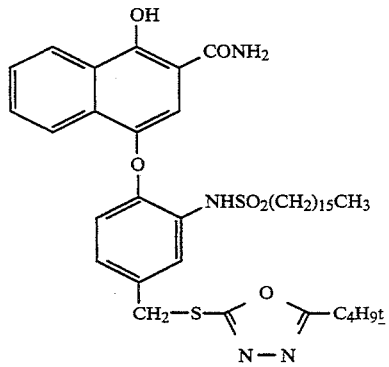

DIR-41

In order to incorporate the compounds according to the present invention and couplers to be used together into a silver halide emulsion layer known methods, including those described, e.g., in U.S. Pat. No. 2,322,027 can be used. For example, they can be dissolved in a solvent and then dispersed in a hydrophilic colloid. Examples of solvents usable for this process include organic solvents having a high boiling point, such as alkyl esters of phthalic acid (e.g., dibutyl phthalate, dioctyl phthalate, etc.), phosphoric acid esters (e.g., diphenyl phosphate, triphenyl phosphate, tricresyl phosphate, dioctyl butyl phosphate, etc.) citric acid esters (e.g., tributyl acetyl citrate, etc.) benzoic acid esters (e.g., octyl benzoate, etc.), alkylamides (e.g., diethyl laurylamides, etc.), esters of fatty acids (e.g. dibutoxyethyl succinate, dioctyl azelate, etc.), trimesic acid esters (e.g., tributyl trimesate, etc.), or the like; and organic solvents having a boiling point of from about 30° to about 150° C., such as lower alkyl acetates (e.g., ethyl acetate, butyl acetate, etc.), ethyl propionate, secondary butyl alcohol, methyl isobutyl ketone, b-ethoxyethyl acetate, methyl cellosolve acetate, or the like. Mixtures of organic solvents having a high boiling point and organic solvents having a low boiling point can also be used.

It is also possible to utilize the dispersing method using polymers, as described in Japanese Patent Publication No. 39853/76 and Japanese Patent Application (OPI) No. 59943/76.

Of the couplers, those having an acid group, such as a carboxylic acid group or a sulfonic acid group, can be introduced into hydrophilic colloids as an aqueous alkaline solution.

As the binder or the protective colloid for the photographic emulsion layers or intermediate layers of the photographic light-sensitive material of the present invention, gelatin is advantageously used, but other hydrophilic colloids can be used alone or together with gelatin.

As gelatin in the present invention, not only lime-processed gelatin, but also acid-processed gelatin may be employed. The methods for preparation of gelatin are described in greater detail in Ather Veis, *The Macromolecular Chemistry of Gelatin,* Academic Press (1964).

As the above-described hydrophilic colloids other than gelatin, it is possible to use proteins such as gelatin derivatives, graft polymers of gelatin and other polymers, albumin, casein, etc.; saccharides such as cellulose derivatives such as hydroxyethyl cellulose, cellulose sulfate, etc., sodium alginate, starch derivatives, etc.; and various synthetic hydrophilic high molecular weight substances such as homopolymers or copolymers, for example, polyvinyl alcohol, polyvinyl alcohol semiacetal, poly-N-vinylpyrrolidone, polyacrylic acid, polymethacrylic acid, polyacrylamide, polyvinyl imidazole, polyvinylpyrazole, etc.

In the photographic emulsion layer of the photographic light-sensitive material used in the present invention, any of silver bromide, silver iodobromide, silver iodochlorobromide, silver chlorobromide and silver chloride may be used as the silver halide. A preferred silver halide is silver iodobromide containing 15 mol % or less of silver iodide. A silver iodobromide emulsion containing from 2 mol % to 12 mol % of silver iodide is particularly preferred.

Although the mean grain size of silver halide particles in the photographic emulsion (the mean grain size being determined with a grain diameter in those particles which are spherical or nearly spherical, and an edge length in those particles which are cubic as a grain size, and is expressed as a mean value calculated from projected areas) is not particularly limited, it is preferably 6 μm or less.

The distribution of grain size may be broad or narrow.

Silver halide particles in the photographic emulsion may have a regular crystal structure, e.g., a cubic or octahedral structure, an irregular crystal structure, e.g., a spherical or plate-like structure, or a composite structure thereof. In addition, silver halide particles composed of those having different crystal structures may be used.

Further, the photographic emulsion wherein at least 50 percent of the total projected area of silver halide particles in tabular silver halide particles having a diameter at least five times their thickness may be employed.

The inner portion and the surface layer of silver halide particles may be different in phase. Silver halide particles may be those in which a latent image is formed mainly on the surface thereof, or those in which a latent image is formed mainly in the interior thereof.

The photographic emulsion used in the present invention can be prepared in any suitable manner, e.g., by the methods as described in P. Glafkides, *Chimie et Physique Photographique,* Paul Montel (1967), G. F. Duffin, Photographic *Emulsion Chemistry,* The Focal Press (1966), and V. L. Zelikman et al., *Making and Coating Photographic Emulsion,* The Focal Press (1964). That is, any of an acid process, a neutral process, an ammonia process, etc., can be employed.

Soluble silver salts and soluble halogen salts can be reacted by techniques such as a single jet process, a double-jet process, and a combination thereof. In addition, there can be employed a method (so-called reversal mixing process) in which silver halide particles are formed in the presence of an excess of silver ions.

As one system of the double jet process, a so-called controlled double jet process in which the pAg in a liquid phase where silver halide is formed is maintained at a predetermined level can be employed. This process can produce a silver halide emulsion in which the crystal form is regular and the grain size is nearly uniform.

Two or more kinds of silver halide emulsions which are prepared separately may be used as a mixture.

The formation or physical ripening of silver halide particles may be carried out in the presence of cadmium salts, zinc salts, lead salts, thallium salts, iridium salts or its complex salts, the rhodium salts or its complex salts, iron salts or its complex salts, and the like.

For removal of soluble salts from the emulsion after precipitate formation or physical ripening, a well known noodle washing process in which gelatin is gelated may be used. In addition, a flocculation process utilizing inorganic salts having a polyvalent anion (e.g., sodium sulfate), anionic surface active agents, anionic polymers (e.g., polystyrenesulfonic acid), or gelatin derivatives (e.g., aliphatic acylated gelatin, aromatic acrylated gelatin and aromatic carbamoylated gelatin) may be used.

Silver halide emulsions are usually chemically sensitized. For this chemical sensitization, for example, the methods as described in H. Frieser ed., *Die Grundlagen Der Photographischen Prozesse mir Silberhalogeniden,* Akademische Verlagsgesellschaft, pages 675 to 734 (1968) can be used. Namely, a sulfur sensitization process using active gelatin or compounds (e.g., thiosulfates, thioureas, mercapto compounds and rhodanines) containing sulfur capable of reacting with silver; a reduction sensitization process using reducing substances (e.g., stannous salts, amines, hydrazine derivatives, formamidinesulfinic acid and silane compounds); a noble metal sensitization process using noble metal compounds (e.g., complex salts of Group VIII metals in the Periodic Table, such as Pt, Ir and Pd, etc., as well as gold complex salts); and so forth can be applied alone or in combination with each other.

The photographic emulsion used in the present invention may include various compounds for the purpose of preventing fog formation or of stabilizing photographic performance in the photographic light sensitive material during the production, storage or photographic processing thereof. For example, those compounds known as antifoggants or stabilizers can be incorporated, including azoles such as benzothiazolium salts; nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particular 1-phenyl-5-mercaptotetrazole), etc.; mercaptopyrimidines; mercaptotriazines; thioketo compounds such as oxazolinethione, etc.; azaindenes such as triazaindenes, tetraazaindenes (particularly 4-hydroxysubstituted (1,3,3a,7)tetraazaindenes), pentaazaindenes, etc.; benzenethiosulfonic acids; benzenesulfinic acids; benzenesulfonic amides, etc.

In the photographic emulsion layers or other hydrophilic colloid layers of the photographic lightsensitive material of the present invention can be incorporated various surface active agents as coating aids or for other various purposes, e.g., prevention of charging, improvement of slipping properties, acceleration of emulsification and dispersion, prevention of adhesion and improvement of photographic characteristics (for example, development acceleration, high contrast, and sensitization), etc.

Surface active agents which can be used are nonionic surface active agents, e.g., saponin (steroid-based), alkyene oxide derivatives (e.g., polyethylene glycol, a polyethylene glycol/polypropylene glycol condensate, polyethylene glycol alkyl ethers or polyethylene glycol alkylaryl ethers, polyethylene glycol esters, polyethylene glycol sorbitan esters, polyalkylene glycol alkylamines or polyalkylene glycol alkylamides, and silicone/polyethylene oxide adducts, etc.), glycidol derivatives (e.g., alkenylsuccinic acid polyglyceride and alkylphenol polyglyceride, etc.), fatty acid esters of polyhydric alcohols and alkyl esters of sugar, etc.; anionic surface active agents containing an acidic group, such as a carboxy group, a sulfo group, a phospho group, a sulfuric acid esters group, and a phosphoric acid ester group, for example, alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkylpolyoxyethylene alkylphenyl ethers, and polyoxyethylene alkylphosphoric acid esters, amphoteric surface active agents, such as amino acids, aminoalkylsulfonic acids, aminoalkylsulfuric acid or aminoalkylphosphoric acid esters, alkylbetaines, and amine oxides; and cationic surface active agents, e.g., alkylamine salts, aliphatic or aromatic quaternary ammonium salts, heterocyclic quaternary ammonium salts (e.g., pyridinium and imidazolium) and aliphatic or hetercyclic phosphonium or sulfonium salts.

The photographic emulsion layer of the photographic light-sensitive material of the present invention may contain compounds such as polyalkylene oxide or its ether, ester, amine or like derivatives, thioether compounds, thiomorpholines, quaternary ammonium salt compounds, urethane derivatives, urea derivatives, imidazole derivatives, and 3-pyrazolidones for the purpose of increasing sensitivity or contrast, or of accelerating development.

In the photographic emulsion layer or other hydrophilic colloid layers of the photographic lightsensitive material of the present invention can be incorporated water-insoluble or sparingly soluble synthetic polymer dispersions for the purpose of improving dimensional stability, etc. Synthetic polymers which can be used include homo- or copolymers of alkyl acrylate or methacrylate, alkoxyalkyl acrylate or methacrylate, glycidyl acrylate or methacrylate, acrylamide or methacrylamide, vinyl esters (e.g., vinyl acetate), acrylonitrile, olefins, styrene, etc. and copolymers of the foregoing monomers and acrylic acid, methacrylic acid, $\alpha,\beta$-unsaturated dicarboxylic acid, hydroxyalkyl acrylate or methacrylate, sulfoalkyl acrylate or methacrylate, and styrenesulfonic acid, etc.

In photographic processing of layers composed of photographic emulsions in the photographic light sensitive material of the present invention, any of known procedures and known processing solutions, e.g., those described in *Research Disclosure,* No. 176, pages 28 to 30 can be used. The processing temperature is usually chosen from between 18° C. and 50° C., although it may be lower than 18° C. or higher than 50° C.

Any fixing solutions which have compositions generally used can be used in the present invention. As fixing agents, thiosulfuric acid salts and thiocyanic acid salts, and in addition, organic sulfur compounds which are known to be effective as fixing agents can be used. These fixing solutions may contain water-soluble aluminum salts as hardeners.

Color developing solutions are usually alkaline aqueous solutions containing color developing agents. As these color developing agents, known primary aromatic amine developing agents, e.g., phenylenediamines such as 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-$\beta$-methanesulfonamidoethylaniline, 4-amino-3-methyl-N-ethyl-N-$\alpha$-methoxyethylaniline, etc., can be used to make exhaustive color reversal developers.

In addition, the compounds as described in L. F. A. Mason, *Photographic Processing Chemistry,* Focal Press, pages 226 to 229 (1966), U.S. Pat. Nos. 2,193,015 and 2,592,364, Japanese Patent Application (OPI) No. 64933/73, etc., may be used.

The color developing solutions can further contain pH buffering agents such as sulfite, carbonates, borates and phosphates of alkali metals, etc. developing inhibitors or anti-fogging agents such as bromides, iodides or organic anti-fogging agents, etc. In addition, if desired, the color developing solution can also contain water softeners; preservatives such as hydroxylamine, etc.; organic solvents such as benzyl alcohol, diethylene glycol, etc.; developing accelerators such as polyethylene glycol, quaternary ammonium salts, amines, etc; dye forming couplers; competing couplers; fogging agents such a sodium borohydride, etc.; auxiliary developing agents; viscosity-imparting agents; acid type chelating agents; anti-oxidizing agents; and the like.

After color developing, the photographic emulsion layer is usually bleached. This bleach processing may be performed simultaneously with a fix processing, or they may be performed independently.

Bleaching agents which can be used include compounds of metals, e.g., iron (III), cobalt (III), chromium (VI), and copper (II) compounds. For example, organic complex salts of iron (III) or cobalt (III), e.g., complex salts of acids (e.g., nitrilotriacetic acid, 1,3-diamino-2-propanoltetraacetic acid, etc.) or organic acids (e.g., citric acid, tartaric acid, malic acid, etc.); persulfates; permanganates; nitrosophenol, etc. can be used. Of these compounds, potassium ferricyanide, iron (III) sodium ethylenediaminetetraacetate, and iron (III) ammonium ethylenediaminetetraacetate are particularly useful. Ethylenediaminetetraacetic acid iron (III) complex salts are useful in both an independent bleaching solution and a mono-bath bleachfixing solution.

The photographic emulsion used in the present invention can also be spectrally sensitized with methine dyes or other dyes. Suitable dyes which can be employed include cyanine dyes, merocyanine dyes, complex cyanine dyes, complex merocyanine dyes, homopolar cyanine dyes, hemicyanine dyes, styryl dyes, and hemioxonol dyes. Of these dyes, cyanine dyes, merocyanine dyes and complex merocyanine dyes are particularly useful.

Any conventionally utilized nuclei for cyanine dyes are applicable to these dyes as basic heterocyclic nuclei. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei can also be substituted.

The merocyanine dyes and the complex merocyanine dyes that can be employed contain 5- or 6-membered heterocyclic nuclei such as pyrazolin-5-one nucleus, a thiohydantoin nucleus, a 2-thioxazolidin-2,4-dione nucleus, a thiazolidine-2,4-dione nucleus, a rhodanine nucleus, a thiobarbituric acid nucleus, and the like.

These sensitizing dyes can be employed individually, and can also be employed in combination. A combination of sensitizing dyes is often used particularly for the purpose of supersensitization.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No, 3,743,510), cadmium salts, azaindene compounds, and the like, can be present.

The present invention is also applicable to a multilayer multicolor photographic material containing layers sensitive to at least two different spectral wavelength ranges on a support. A multilayer color photographic material generally possesses at least one red-sensitive silver halide emulsion layer, at least one green-sensitive silver halide emulsion layer and at least one blue-sensitive silver halide emulsion layer, respectively, on a support. The order of these layers can be varied, if desired. Ordinarily, a cyan forming coupler is present in a red-sensitive emulsion layer, a magenta forming coupler is present in a green-sensitive emulsion layer and yellow forming coupler is present in a blue-sensitive emulsion layer, respectively. However, if desired, a different combination can be employed.

The color reversal films of this invention are typically multilayer materials such as described in U.S. Pat. No. 4,082,553, U.S. Pat. No. 4,729,943, and U.S. Pat. No. 4,912,024; paragraph bridging pages 37–38. The support and other elements are as known in the art, e.g. see U.S. Pat. No. 4,912,024, column 38, line 37, and references cited therein.

EXAMPLE 1

The invention is illustrated by the following example:

A method for the determination of "inhibitor strength" is described below:

First, a green sensitive silver bromoiodide gelatin emulsion containing 4.0 mol-percent iodide and having an approximate grain length/thickness ratio of 0.70/0.09 micrometers was mixed with a coupler dispersion comprising Cyan Coupler C-1 dispersed in half its weight of di-n-butylphthalate. The resulting mixture was coated onto a cellulose triacetate support according to the following format:

| | | |
|---|---|---|
| OVERCOAT LAYER: | gelatin | 7.5 g/m2 |
| | bis(vinylsulfonylmethyl)ether hardener (1.9% of total gelatin weight) | |
| EMULSION LAYER: | AgBrI emulsion | 1.08 g/m2 (as silver) |
| | coupler | 2.07 mmoles/m2 |
| | gelatin | 4.04 g/m2 |
| FILM SUPPORT | | |

The resulting photographic element (hereafter referred to as the test coating) was cut into 12 inch×35mm strips and was imagewise exposed to light through a graduated density test object in a commercial sensitometer (3000 K light source, 0–3 step wedge, with a Wratten 99 plus 0.3 ND filter) for 0.01 sec to provide a developable latent image. The exposed strip as then slit lengthwise into two 12 inch×16 mm strips. One strip so prepared was subjected to the photographic process sequence outlined below:

| | |
|---|---|
| First developer | 4 min. |
| Water wash | 2 min. |
| Reversal bath | 2 min. |
| Color developer | 4 min. |
| Conditioner | 2 min. |
| Bleach | 6 min. |
| Fix | 4 min. |
| Water wash | 2 min. |

All solutions of the above process were held at a temperature of 36.9° C. The compositions of the processing solution are as follows:

| | |
|---|---|
| First developer: | |
| Amino tris(methylenephosphonic acid), pentasodium salt | 0.56 g |
| Diethylenetriaminepentaacetic acid, pentasodium salt | 2.50 g |
| Potassium sulfite | 29.75 g |
| Sodium bromide | 2.34 g |
| Potassium hydroxide | 4.28 g |
| Potassium iodide | 4.50 mg |
| 4-Hydroxymethyl-4-methyl-1-phenyl-3-pyrazolidinone | 1.50 g |
| Potassium carbonate | 14.00 g |
| Sodium bicarbonate | 12.00 g |
| Potassium hydroquinone sulfonate | 23.40 g |
| Acetic acid (glacial) | 0.58 g |
| Water to make 1.0 liter | |
| Reversal bath: | |
| Propionic acid | 11.90 g |
| Stannous chloride (anhydrous) | 1.65 g |
| p-Aminophenol | 0.5 mg |
| Sodium hydroxide | 4.96 g |
| Amino tris(methylenephosphonic acid), | 8.44 g |
| Water to make 1.0 liter | |
| Color Developer: | |
| Amino tris(methylenephosphonic acid), pentasodium salt | 2.67 g |
| Phosphoric acid (75% solution) | 17.40 g |
| Sodium bromide | 0.65 g |
| Potassium iodide | 37.5 mg |
| Potassium hydroxide | 27.72 g |
| Sodium sulfite | 6.08 g |
| Sodium metabisulfite | 0.50 g |
| Citrazinic acid | 0.57 g |
| Methanesulfonamide, N-[2-[(4-amino-3-methylphenyl)ethylamino]ethyl]-sulfate (2:3) | 10.42 g |
| 3,6-dithia-1,8-octanediol | 0.87 g |
| Acetic acid (glacial) | 1.16 g |
| Water to make 1.0 liter | |
| Conditioner: | |
| (Ethylenedinitrillo)tetraacetic acid | 8.00 g |
| Potassium sulfite | 13.10 g |
| Thioglycerol | 0.52 g |
| Water to make 1.0 liter | |
| Bleach: | |
| Potassium nitrate | 25.00 g |
| Ammonium bromide | 64.20 g |
| Ammonium ferric (ethylenediamine) | 124.9 g |
| Hydrobromic acid | 24.58 g |
| (Ethylenedinitrilo)tetraacetic acid | 4.00 g |
| Potassium hydroxide | 1.74 g |
| Water to make 1.0 liter | |
| Fixer: | |
| Ammonium thiosulfate | 95.49 g |
| Ammonium sulfite | 6.76 g |
| (Ethylenedinitrilo)tetraacetic acid | 0.59 g |
| Sodium metabisulfite | 7.12 g |
| Sodium hydroxide | 1.00 g |
| Water to make 1.0 liter | |

After the test coating was subjected to this processing sequence and dried the maximum density was read to status A densitometry using a commercial densitometer. This density is called $D_{max}$ (solution A). The other half of the exposed test coating was processed through the same sequence except that the color developer contained 0.25 mmol of the INH compound in addition to the components listed in the above formula. The maximum density obtained for the test coating processed in this manner is called $D_{max}$ (solution B). The inhibitor number, IN, of the INH compound is defined as:

$$IN = \frac{D_{max}\text{ (solution A)} - D_{max}\text{ (solution B)}}{D_{max}\text{ (solution A)}} \times 100$$

The inhibitor strength, IS, of the INH compound is defined as:

$$IS = \frac{IN_{(test)}}{IN_{(control)}}$$

where $IN_{(test)}$ is the inhibitor number determined by the method described above for any INH compound of interest, and $IN_{(control)}$ is the inhibitor number determined for the test coating when 1-phenyl-5-mercapto-1,2,3,4-tetrazole is the INH compound incorporated into the color developer.

It has been found that compounds having the structural formula

CAR—(TIME)$_n$—INH wherein INH comprises a compound that has a inhibitor strength greater than 1 provide particularly desirable results when incorporated into color reversal photographic elements.

The following examples further illustrate this invention:

EXAMPLE 1A 1.0 g of DIR-2 was dissolved in 2.0 g of N,N-Diethyl lauramide and 3.0 g of ethyl acetate with gentle heating. This solution was then brought to a temperature of 40° C. and then mixed with a solution containing 3.0 g pig gelatin and 0.3 g of the sodium salt of triisopropylnathphalene sulfonic acid dissolved in 40.7 g. of distilled water. The resulting mixture was then passed through a colloid mill three times to produce a dispersion. This dispersion was then used to prepare a photographic element designated as Sample 101 having the composition set forth below:

In the composition of the layers, the coating amounts are shown as g/m$^2$, except for sensitizing dyes, which are shown as the molar amount per mole of silver halide present in the same layer.

Photographic support: cellulose triacetate subbed with gelatin.

| | |
|---|---|
| First layer: Red sensitive layer | |
| Silver iodobromide emulsion (as silver) (4 mol % iodide) | 1.18 |
| Red sensitizing dyes | $1.42 \times 10^{-3}$ |
| Cyan Coupler C-1 | 1.71 |
| Tritolylphosphate | 0.85 |
| DIR-2 | 0.04 |
| Gelatin | 4.03 |
| Second layer: Intermediate layer | |
| Competitor S-3 | 0.16 |
| Dye-1 | 0.06 |
| Gelatin | 0.86 |
| Third layer: Green sensitive layer | |
| Silver iodobromide emulsion (as silver) (4 mol % iodide) | 1.18 |
| Green sensitizing dyes | $2.0 \times 10^{-3}$ |
| Coupler M-1 | 1.67 |
| Tritolylphosphate | 0.84 |
| Gelatin | 4.03 |
| Fourth layer: Protective layer | |
| Gelatin | 3.23 |
| Bis(vinylsulfonylmethane) | 0.23 |

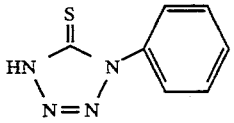

COM INH-1

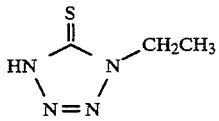

COM INH-2

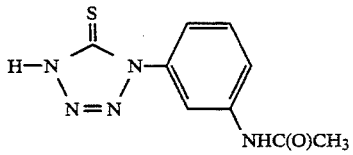

COM INH-3

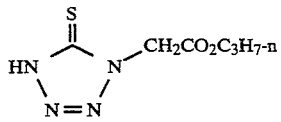

COM INH-4

-continued
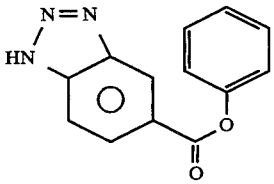
COM INH-5
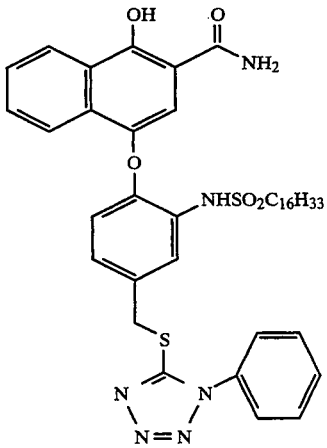
COM DIR-1
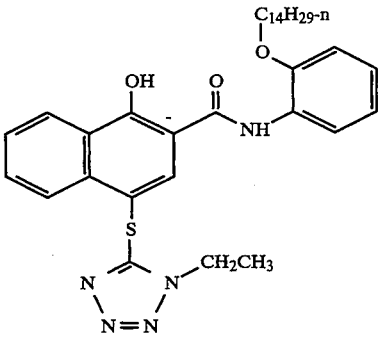
COM DIR-2
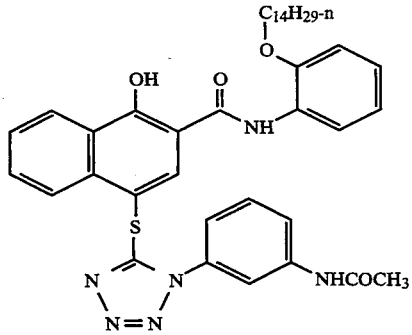
COM DIR-3

-continued
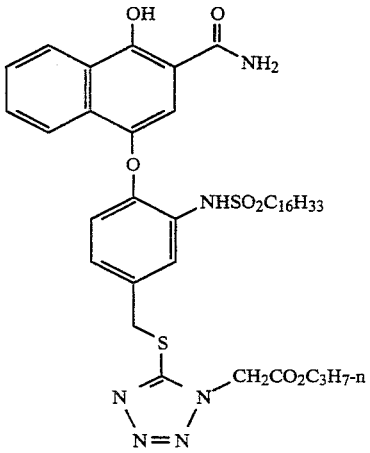
COM DIR-4
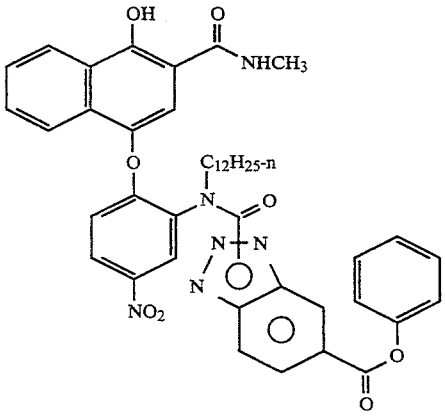
COM DIR-5
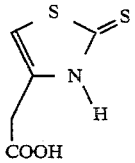
Antifoggant
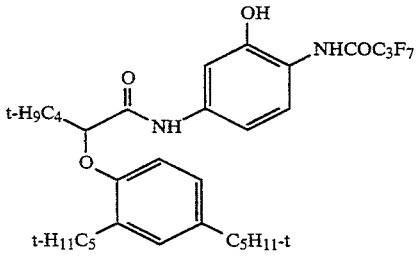
C-1
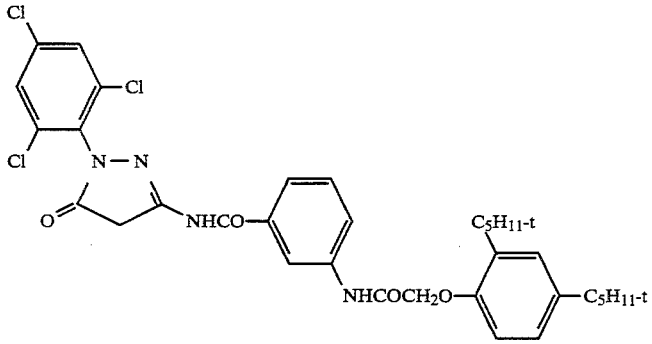
M-1

-continued
M-2
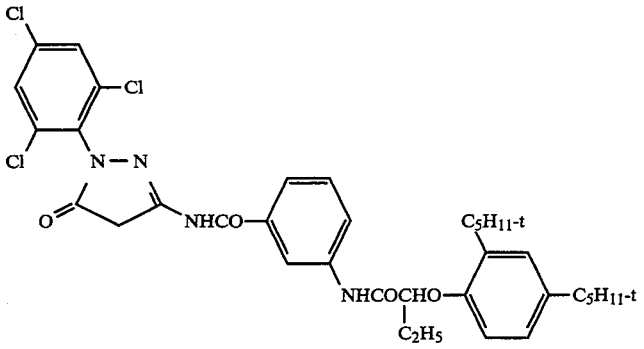
Y-1
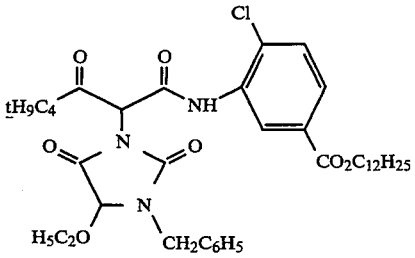
S 1
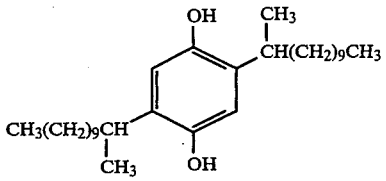
S-2
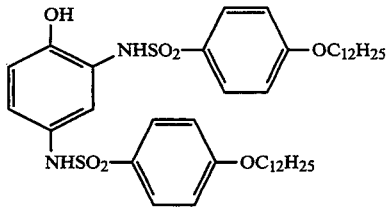
S-3
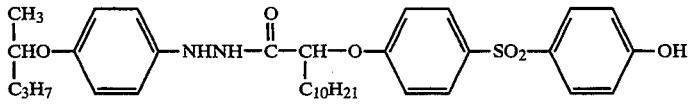
DYE-1
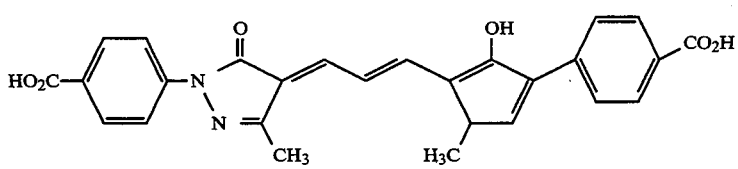
SENSITIZING DYE-1
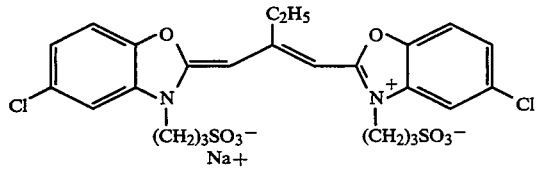
SENSITIZING DYE-2
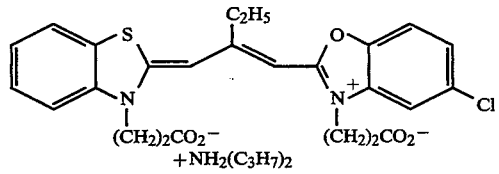

-continued

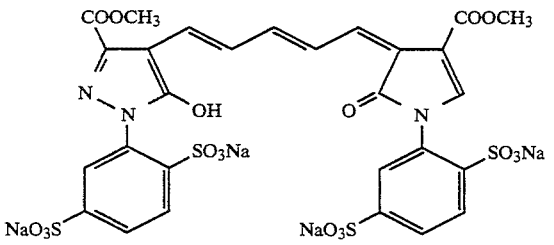

Cyan Absorber Dye

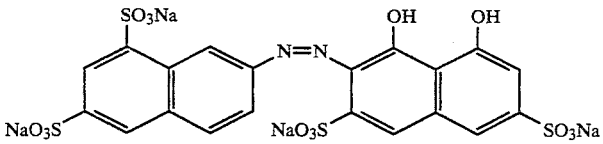

Magenta Absorber Dye

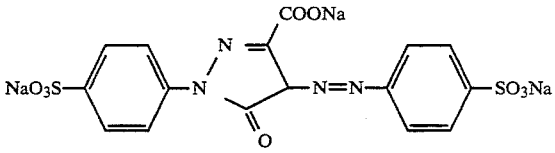

Yellow Absorber Dye

In a similar fashion samples 102 to 109 were prepared except that DIR-2 was replaced with equimolar amounts of the DIR as indicated in Table 1. After drying, the samples were slit into 12 inch×35 mm strips and exposed as follows:

First, the red-sensitive layer was exposed in an imagewise fashion to a 0–3 density step tablet plus a Wratten 29 filter using a commercial sensitometer (3000 k lamp temperature) for 0.01 sec. The green-sensitive layer was then given a uniform flash exposure using the same sensitometer with a Wratten 99 filter, but without the step tablet. The intensity of the green exposure was selected to be that which gave a Status A green analytical maximum density of approximately 2.0, after photographic processing, for sample 100, which was identical in composition to sample 101 except that it contained no DIR. The exposed samples were processed according to the sequence described above. All solutions of the above process were held at a temperature of 36.9° C. The compositions of the processing solution are the same as described above.

After processing, the densities of the samples were read to status A densitometry using a commercial densitometer. The densities were converted to analytical densities in the usual manner so that the red and green densities reflected the amount of cyan and magenta dyes formed in the respective layers. The results are tabulated in Table 2, and the inhibitor strengths of the INH moieties released from the DIR compounds during color development are shown in Table 1. It can be seen that the DIR compounds of this invention that release INH moieties having inhibitor strengths greater than 1.00 produce greater reductions in the red maximum density than do the comparison DIR compounds that release INH fragments having inhibitor strengths less than 1.00. The ability to reduce the density in the layer in which the DIR compound is coated is an indication of DIR compound's ability to produce sharpness improvements. Also recorded in Table 2 is a parameter called Delta $D_{max}$ ($\Delta D_{max}$), which is the difference in the green density measured in an area of the film strip where the red density is a maximum, minus the green density measured in an area where the red density is a minimum. As such, this parameter reflects the ability of a DIR compound coated in one layer to alter the dye formation in another layer. The data in Table 2 shows that DIR compounds of this invention, which release INH moieties that have inhibitor strengths greater than 1, have a substantially greater effect on the dye density formed in the green sensitive layer than do comparison DIR compounds that release INH moieties having inhibitor strengths less than 1. This very desirable property enables the preparation of color reversal elements that have enriched color saturation.

TABLE 1

| Sample | INH | IS |
|---|---|---|
| 100 | none | — |
| 101 | INH-1 | 1.77 |
| 102 | INH-3 | 1.67 |
| 103 | INH-12 | 1.95 |
| 104 | INH-13 | 2.11 |
| 105 | COM INH-1 | 1.00 |
| 106 | COM INH-2 | 0.05 |
| 107 | COM INH-3 | 0.24 |
| 108 | COM INH-4 | 0.00 |
| 109 | COM INH-5 | 0.00 |

TABLE 2

| Sample | DIR | INH in DIR | Red $D_{max}$ | $\Delta D_{max}$ (Green) |
|---|---|---|---|---|
| 100 | none | — | 3.15 | 0.21 |
| 101 | DIR-1 | INH-1 | 2.76 | 0.46 |
| 102 | DIR-23 | INH-3 | 1.67 | 0.41 |
| 103 | DIR-25 | INH-12 | 2.23 | 0.40 |
| 104 | DIR-24 | INH-13 | 1.82 | 0.68 |
| 105 | COM DIR-1 | COM INH-1 | 3.12 | 0.40 |
| 106 | COM DIR-2 | COM INH-2 | 3.21 | 0.20 |
| 107 | COM DIR-3 | COM INH-3 | 3.19 | 0.22 |
| 108 | COM DIR-4 | COM INH-4 | 3.21 | 0.29 |
| 109 | COM DIR-5 | COM INH-5 | 3.20 | 0.30 |

EXAMPLE 2

The following example further illustrates the invention.

On a cellulose triacetate film support provided with a subbing layer was coated each layer having the composition set forth below to prepare a multilayer color photographic light sensitive material, which is designated sample 201. The coating amounts shown are g/m$^2$.

| | |
|---|---|
| First layer: Antihalation layer | |
| Black colloidal silver | 0.31 (as silver) |
| Gelatin | 2.44 |
| Second layer: Intermediate layer | |
| Scavenger S-3 | 0.05 |
| Dibutyl phthalate | 0.05 |
| Gelatin | 1.22 |
| Third layer: Slow red-sensitive layer | |
| Red-sensitive silver iodobromide emulsion | 0.05 (as silver) |
| average grain size: | 0.15 mm |
| silver iodide content: 4.8% | |
| Red-sensitive silver iodobromide emulsion | 0.41 (as silver) |
| average grain size: 0.29 mm | |
| silver iodide content: | 4.8% |
| Cyan coupler C-1 | 0.17 |
| Dibutyl phthalate | 0.13 |
| Scavenger S-3 | 0.04 |
| Gelatin | 1.52 |
| Cyan absorber dye | 0.005 |
| Fourth layer: Fast red-sensitive layer | |
| Red-sensitive iodobromide emulsion | 1.02 (as silver) |
| average grain size: | 0.58 mm |
| silver iodide content: | 3.4% |
| Cyan coupler C-1 | 1.27 |
| Dibutyl phthalate | 0.64 |
| DIR Coupler D-1 | 0.04 |
| Tritolyl phosphates | 0.13 |
| Gelatin | 2.02 |
| Fifth layer: Intermediate layer | |
| Scavenger S-1 | 0.15 |
| Antifoggant | 0.008 |
| Gelatin | 0.61 |
| Sixth layer: Slow green-sensitive layer | |
| Green-sensitive silver iodobromide emulsion | 0.32 (as silver) |
| average grain size: | 0.15 mm |
| silver iodide content: | 4.8% |
| Green-sensitive silver iodobromide emulsion | 0.32 (as silver) |
| average grain size: | 0.29 mm |
| silver iodide content: | 4.8% |
| Green-sensitive silver iodobromide emulsion | 0.02 (as silver) |
| average grain size: | 0.15 mm |
| silver iodide content: | 4.8% |
| treated to produce 95% fog on 1st development | |
| Magenta coupler M-2 | 0.17 |
| Magenta coupler M-1 | 0.41 |
| Scavenger S-2 | 0.02 |
| Magenta absorber dye | 0.008 |
| Gelatin | 1.08 |
| Seventh layer: Fast green-sensitive layer | |
| Green-sensitive silver iodobromide emulsion | 0.86 (as silver) |
| average grain size: | 0.70 mm |
| silver iodide content: | 2% |
| Magenta coupler M-2 | 0.34 |
| Magenta coupler M-1 | 0.79 |
| Gelatin | 1.76 |
| Eighth layer: Intermediate layer | |
| Cyan absorber dye | 0.007 |
| Magenta absorber dye | 0.004 |
| Yellow absorber dye | 0.20 |
| Gelatin | 0.61 |
| Ninth layer: Yellow filter layer | |
| Carey Lea silver | 0.075 |
| Scavenger S-3 | 0.11 |
| Gelatin | 0.61 |
| Tenth layer: Slow blue-sensitive layer | |
| Blue-sensitive silver iodobromide emulsion | 0.32 (as silver) |

-continued

| | |
|---|---|
| average grain size: | 0.32 mm |
| average iodide content: | 3.4% |
| Blue-sensitive silver iodobromide emulsion | 0.26 (as silver) |
| average grain size: | 0.66 mm |
| average iodide content: | 3.4% |
| Yellow coupler Y-1 | 0.81 |
| Yellow absorber dye | 0.04 |
| Gelatin | 1.35 |
| Bis(vinylsulfonylmethane) | 0.28 |
| Eleventh layer: Fast blue-sensitive layer | |
| Blue-sensitive silver iodobromide | 1.11 (as silver) |
| average grain size: | 1.49 mm |
| average iodide content: | 2% |
| Yellow coupler Y-1 | 1.67 |
| Gelatin | 2.62 |
| Twelfth layer: First protective layer | |
| Ultraviolet absorbing dyes | 0.44 |
| Gelatin | 1.08 |
| Thirteenth layer: Second protective layer | |
| Carey Lea silver | 0.003 |
| Fine grained silver bromide emulsion | 0.12 |
| Matte | 0.02 |
| Gelatin | 0.86 |

Sample 201 of the invention and samples of eighteen commercial color reversal photographic film products, designated A through R, were exposed to a chart containing a neutral, a red, and a yellow-red tint, or skin, standard test object. After exposure, all films were subjected to Kodak E-6 processing, using 4-(N-ethyl-N-2-methanesulfonamidoethyl)-2-methylphenylenediamine sesquisulfate monohydrate as color developing agent.

The test chart contained three matte reflection patches, identified below:

| | Munsell Notation | | | CIELab Values | | |
|---|---|---|---|---|---|---|
| | hue | value | chroma | a* | b* | L* |
| (1)Neutral | N | 5 | 0 | 0.18 | 0.27 | 51.10 |
| (2)Red | 7.5R | 4 | 6 | 30.46 | 19.16 | 40.12 |
| (3)Skin | 2.2YR | 6.47 | 4.1 | 17.26 | 18.01 | 66.98 |

The reflection patches were obtained from Munsell Color, Macbeth Division of Kollmorgen Instruments Corporation Newburgh, N.Y. The reference white for the CIELab calculations of the original patches is $D_{55}$. The standard for Munsell notation is Illuminant C (cf Davidson, Godlove, and Hemmendinger, *Journal of the Optical Society of America,* 1957, Vol. 47, p. 336). Spectral density traces from 400 to 700 nm were obtained for these reflection samples using a spectrophotometer with 45/0 geometry with black backing.

Each of the comparison and experimental films were exposed using a typical single-lens reflex camera. The photographic taking illuminant was a tungsten halogen lamp with a daylight filter producing a correlated color temperature of 7200$\phi$ K. The relative Green, Red and Blue exposures of this taking illuminant compared to an ISO sensitometric daylight source (ANSI PH2.29-1985), which is the product of standard photographic daylight $D_{55}$ and the relative spectral transmittance of the ISO standard camera lens, were 0, +0.129, and +0.388, respectively. These exposure values, which define the quality of the illumination at the film plane, may be replicated through the proper combination of a lamp and selectively absorbing filters. Any taking illuminant that meets the exposure index tolerances of the ANSI sensitometric illuminant (4/0/1 for Blue/-

Green/Red) will suffice as the taking illuminant defined in this method.

Each of the films were exposed so that the neutral Munsell N,5,0 patch on the film corresponded to a Green Status A density of 1.0 n 0.04. The red, skin, and neutral patches on the film that corresponded to the 1.0 density were measured with a spectrophotometer to obtain their total transmission spectral density characteristics from 400 to 700 nm. If a single film exposure did not meet the 1.0 density requirement, two exposures that bracketed the 1.0 density were spectrophotometrically measured and then linearly interpolated to obtain an approximate 1.0 Status A green density.

Reproduction coefficients (RC) for the red and the yellow-red tint, or skin, patches, which are defined as the ratio of the reproduction chroma ($C^{*R}$) to the corresponding original chroma ($C^*$) for each patch, were determined using CIE Publication 15.2, *Colorimetry* (1986), recommendations for the 1931 CIE standard colorimetric observer (2 degree). From the reproduction coefficients (RC) determined for the red and yellow-red patches, the values of the ratio of the red reproduction coefficient and the yellow-red tint, or skin, reproduction coefficient can be calculated.

To calculate CIELab values, the 1976 CIELab color space calculations recommended in CIE Publication 15.2 were used. Spectral data from 400 to 700 nm were used for the tristimulus value calculations. The reference white used in the calculation of a*, b*, and L* was the Munsell N, 5,0 patch of the photographic reproduction rescaled to a Y of 100 to normalize balance differences between the films. The tristimulus values of the N,5,0 reproduction were calculated for each film assuming a $D_{55}$ viewing illuminant. These tristimulus values, which have a Y approximately 50, were rescaled so that the Y value equals 100 while maintaining constant chromaticities by multiplying each of the tristimulus values by ($100/Y_{N,5,0}$). The CIELab parameters for red and yellow-red tint were calculated using the rescaled reference white.

The values of the reproduction coefficients (RC) for the red and yellow-red tint, or skin, patches and their ratios that were determined for the element of the invention and for each of the commercial color reversal film products are given in Table 3 below.

TABLE 3

| Sample | Red RC | Skin RC | Red RC/Skin RC |
|---|---|---|---|
| 201 | 0.93 | 0.75 | 1.24 |
| product A | 0.94 | 0.90 | 1.05 |
| product B | 0.85 | 0.90 | 0.95 |
| product C | 0.78 | 0.86 | 0.91 |
| product D | 0.74 | 0.59 | 1.25 |
| product E | 0.74 | 0.78 | 0.95 |
| product F | 0.78 | 0.88 | 0.89 |
| product G | 0.91 | 0.83 | 1.10 |
| product H | 0.90 | 0.83 | 1.08 |
| product I | 0.73 | 0.83 | 0.88 |
| product J | 0.70 | 0.94 | 0.75 |
| product K | 0.78 | 0.86 | 0.91 |
| product L | 0.65 | 0.77 | 0.84 |
| product M | 0.83 | 0.57 | 1.46 |
| product N | 1.02 | 1.08 | 0.95 |
| product O | 0.87 | 0.83 | 1.04 |
| product P | 0.89 | 1.02 | 0.87 |
| product Q | 0.88 | 0.89 | 0.99 |
| product R | 0.87 | 0.89 | 0.98 |

In accordance with the present invention, the red patch is reproduced with a reproduction coefficient (RC) of greater than or equal to 0.88, and the ratio of red RC/yellow-red tint RC is greater than or equal to 1.15. This describes a film that displays both red colors of high relative chroma and more accurate and pleasing skin tone rendition that is not excessively high in chroma with respect to the original. This highly desirable color reproduction position is attained with the color reversal photographic element of the invention but not with any of the commercial products included in the test.

EXAMPLE 3

The invention is illustrated by the following example in which a film element is processed in an E-6 process.

On a cellulose triacetate film support provided with a subbing layer was coating each layer having the composition set forth below to prepare a multilayer color photographic light sensitive material, which is designated sample 301.

In the composition of the layers, the coating amounts are shown as g/m$^2$ except for sensitizing dyes, which are shown as molar amounts per mole of silver halide present in the same layer.

| | |
|---|---|
| First layer: Antihalation layer | |
| Black colloidal silver | 0.31 (as silver) |
| Gelatin | 2.44 |
| Second layer: Intermediate layer | |
| Scavenger S-1 | 0.05 |
| Fine grained silver bromide emulsion | 0.05 |
| Gelatin | 1.22 |
| Third layer: Slow red sensitive layer | |
| Red sensitive silver iodobromide emulsion | 0.43 (as silver) |
| Fine grained silver bromide emulsion | 0.04 |
| Cyan coupler C-1 | 0.16 |
| Dibutylpthalate | 0.10 |
| Scavenger S-2 | 0.02 |
| Gelatin | 1.08 |
| Fourth layer: Fast red sensitive layer | |
| Red senstive silver iodobromide emulsion | 0.93 (as silver) |
| Fine grained silver bromide emulsion | 0.06 |
| Cyan coupler C-1 | 1.40 |
| Dibutylpthalate | 0.70 |
| Gelatin | 2.91 |
| Fifth layer: Intermediate layer | |
| Scavenger S-1 | 0.32 |
| Magenta filter dye | 0.06 |
| Gelatin | 0.61 |
| Sixth layer: Slow green sensitive layer | |
| Green sensitive silver iodobromide emulsion | 0.59 (as silver) |
| Magenta coupler M-2 | 0.05 |
| Magenta coupler M-1 | 0.11 |
| Tritolylphosphate | 0.08 |
| Gelatin | 0.86 |
| Seventh layer: Fast green sensitive layer | |
| Greeen sensitive silver iodobromide emulsion | 0.70 (as silver) |
| Magenta Coupler M-2 | 0.29 |
| Magenta Coupler M-1 | 0.68 |
| Tritolylphosphate | 0.49 |
| Gelatin | 2.15 |
| Eight layer: Intermediate layer | |
| Yellow filter dye | 0.27 |
| Scavenger S-1 | 0.32 |
| Gelatin | 0.70 |
| Ninth layer: Slow blue sensitive layer | |
| Blue sensitive silver iodobromide emulsion | 0.22 (as silver) |
| Fine grained silver bromide emulsion | 0.04 |
| Yellow coupler Y-1 | 0.70 |

-continued

| | |
|---|---|
| Dibutylpthalate | 0.23 |
| Gelatin | 0.86 |
| Tenth layer: Fast blue sensitive layer | |
| Blue sensitive silver iodobromide | 0.48 (as silver) |
| Fine grained silver bromide emulsion | 0.06 |
| Yellow coupler Y-1 | 1.72 |
| Dibutylpthalate | 0.57 |
| Gelatin | 2.37 |
| Eleventh layer: First protective layer | |
| Scavenger S-2 | 0.06 |
| Dibutylpthalate | 0.06 |
| Ultraviolet absorbing dyes | 0.45 |
| Gelatin | 1.40 |
| Twelfth layer: Second protective layer | |
| Carey Lea silver | 0.003 |
| Fine grained silver bromide emulsion | 0.12 |
| Matte | 0.02 |
| Gelatin | 0.98 |
| Bis(vinylsulfonylmethane) | 0.30 |

Samples 302 to 303 were prepared in the same way as sample 301 except that 0.03 g/m$^2$ of a DIR coupler were provided in the fast red layer (layer 4). In sample 303, the coated level of red sensitive silver iodobromide in layer 4 was 1.00 g/m$^2$ and the level of coupler C-1 was 1.51, while in layer 7 the coated level of green sensitive silver iodobromide was 0.86 g/m$^2$, the level of coupler M-1 was 0.83 and the level of coupler M-2 was 0.36 g/m$^2$. The coatings were cut into 35 mm strips, exposed and processed using standard E-6 processing solutions and methods. The density differences of a receiver layer, uniformly exposed to green light to produce a density of 1.5, over the exposure range of a causer exposed in step increments over a density of 0 to 3.0 to red light are listed in the table along with 35 mm slide acutance measurements for these coatings.

As can be seen from the results in the table, the coating of the invention shows increased interlayer interimage effects, as shown from the green receiver delta density measurements, and increased green layer acutance compared to either the coating containing no DIR coupler or the coating containing the weak inhibitor releasing COM DIR-4.

| sample no. | DIR coupler | | green receiver delta density d = 1.5 | CMT acutance red | green | blue |
|---|---|---|---|---|---|---|
| 301 | none | comparison | 0.26 | 93.7 | 96.6 | 97.0 |
| 302 | COM-DIR-4 | comparison | 0.35 | 93.2 | 96.7 | 96.8 |
| 303 | DIR-41 | invention | 0.78 | 94.0 | 98.4 | 97.6 |

Sharpness or Acutance may be measured in accordance with the following references.

CMT Acutance

R. G. Gendron, J. Soc. Mot. Pic. Tel. Eng., vol. 82, pp 1009–12 (1973). Reference for the equipment and method for making sharpness measurement of film.

E. M. Crane, J. Soc. Mot. Pic. Tel. Eng., vol. 73, p 643 (1964). Reference for the method of determining CMT values from the sharpness exposures.

Sharpness was calculated using the following formula in which the cascade area under the system modulation curve is shown in equation (21.104) on p. 629 of the THE THEORY OF THE PHOTOGRAPHIC PROCESS, Fourth Edition, 1977, edited by T. H. James The magnification factor M was 3.36 for 35 mm slide.

MTF Accutance

The MTF values were obtained as described in R. L. Lamberts and F. C. Eisen,Journal of Applied Photographic Engineering, vol. 6, Feb. 1980, pp1–8, titled "A System for Automated Evaluation of Modulation Transfer Functions of Photographic Materials".

The invention has been described in detail with particular reference to preferred embodiments thereof, but it will be understood that variations and modifications can be effected within the spirit and scope of the invention.

What is claimed is:

1. A method of processing a color reversal photographic element having:

a support having thereon at least two light-sensitive silver halide emulsion layers and a compound capable of releasing a development inhibitor, the element comprising a compound having the structural formula $$CAR—(TIME)_n—INH$$

wherein:

CAR is a carrier moiety from which —(TIME)$_n$—INH is released during color development;

TIME is a timing group; INH is comprised of a development inhibitor moiety selected from the group consisting of oxazole, thiazole, diazole, oxathiazole, triazole, thiatriazole, benzotriazole, tetrazole, benzimidazole, indazole, isoindazole, mercaptotriazole, mercaptotetrazole, selenotetrazole, mercaptothiazole, selenobenzothiazole, emercaptobenzoxazole, selenobenzoxazole, mercaptobenzimidazole, selenobenzimidazole, benzodiazole, mercaptooxadiazole, or benzisodiazole, the INH having an inhibitor potency greater than 1 (one), and n is 0, 1 or 2, wherein inhibitor potency, IS, of the INH compound is defined as:

$$IS = \frac{IN_{(test)}}{IN_{(control)}}$$

where $IN_{(test)}$ is the inhibitor number of INH and $IN_{(control)}$ is the inhibitor number for 1-phenyl-5-mercapto-1,2,3,4-tetrazole;

the method comprising first treating the element with a black and white developer to develop exposed silver grains, then fogging non-exposed silver halide grains, then treating the element with a color developer.

2. A method in accordance with claim 1 wherein INH has a structure selected from

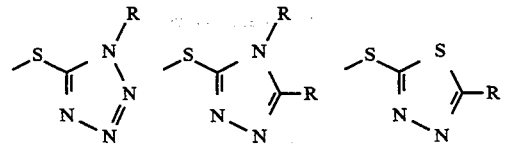

-continued

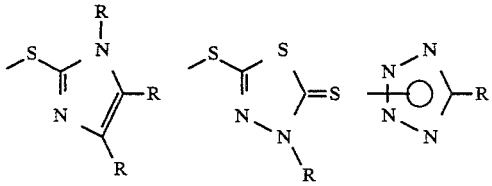

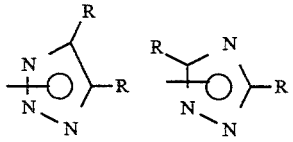

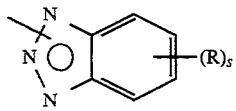

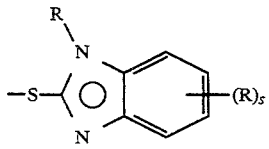

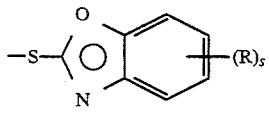

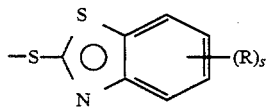

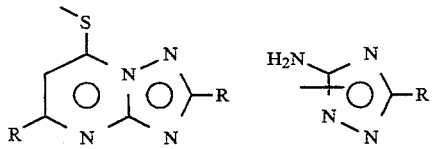

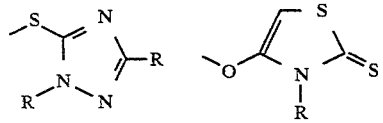

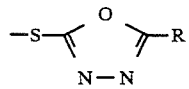

wherein R is a substituted or unsubstituted alkyl group, hydrogen, halogen, a substituted or unsubstituted aryl group, a 5- or 6-membered heterocyclic ring, alkoxy group, aryloxy group, alkoxycarbonyl group, arlyoxycarbonyl group, amino group, sulfamoyl group, sulfonamido group, sulfoxyl group carbamoyl group, alkylsulfo group, arylsulfo group, hydroxy group, aryloxycarbonylamino group, alkoxycarbonylamino group, acylamino group, ureido group, arylthio group, alkylthio group, cyano group, wherein when R is either a substituted alkyl group or a substituted aryl group, the alkyl group or aryl group is substituted by a hydrogen, halogen, alkyl group, 5- or 6-membered heterocyclic ring, alkoxy group, aryloxy group, alkoxycarbonyl group, aryloxycarbonyl group, amino group, sulfamoyl group, sulfonamido group, sulfoxyl group, carbamoyl group, alkylsulfo group, arylsulfo group, hydroxy group, aryloxycarbonylamino group, alkoxycarbonylamino group, acylamino group, ureido group, arylthio group, alkylthio group, or cyano group, and s is 1 to 4.

3. A method in accordance with claim 1 wherein INH selected from:

INH-1

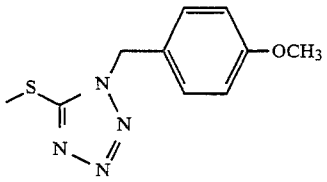

INH-2

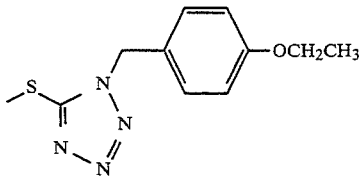

INH-3

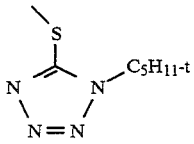

INH-4

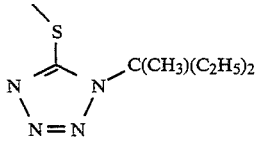

INH-5

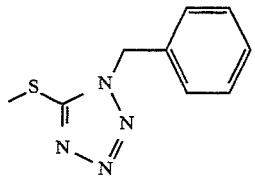

INH-6

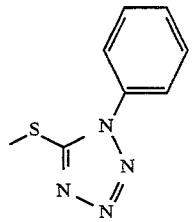

INH-7

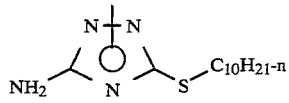

INH-8

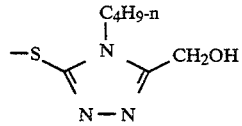

-continued

INH-9

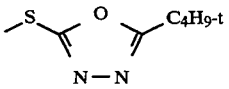

INH-9

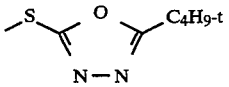

INH-10

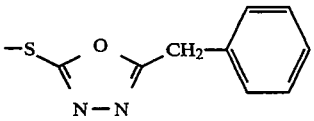

INH-11

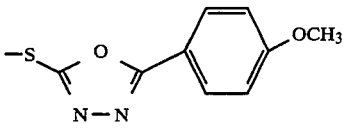

INH-12

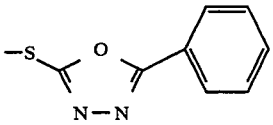

INH-13

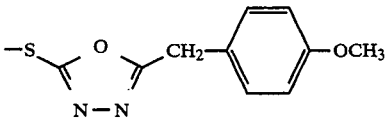

INH-14

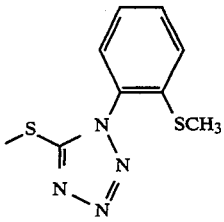

INH-15

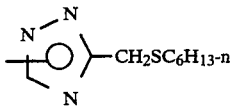

INH-16

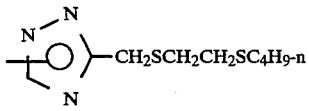

INH-17

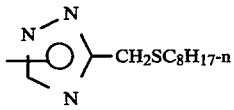

INH-18

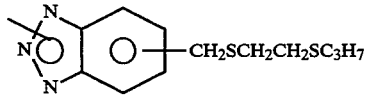

INH-19

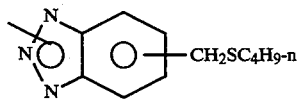

-continued

INH-20

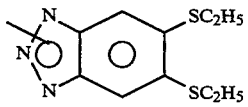

INH-21

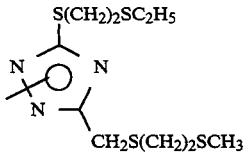

INH-22

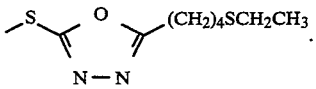

4. The method in accordance with claim 1 wherein CAR is a coupler moiety.

5. The method in accordance with claim 4 wherein the coupler moiety is ballasted.

6. The method in accordance with claim 4 wherein —(TIME)$_n$—INH is bonded to a coupling position of the coupler moiety

7. The method in accordance with claim 1 wherein CAR is unballasted and the TIME moiety attached to CAR is ballasted.

8. The method in accordance with claim 7 wherein CAR is a coupler moiety.

9. The method in accordance with claim 1 wherein CAR is a moiety which can cross-oxidize with oxidized color developer, and is selected from the class consisting of hydrazides and hydroquinones.

10. The method in accordance with claim 1 wherein the compound is present in the element from 0.002 to about 0.35 g/m$^2$.

11. The method in accordance with claim 1 wherein the compound is present in the element from about 0.005 to about 0.15 g/m$^2$.

12. A method of processing a color reversal photographic method having:

a support having thereon at least one photographic silver halide emulsion layer, the element having at least one red sensitive layer, at least one green sensitive layer and at least one blue sensitive layer and containing a development inhibitor releasing compound having the structural formula $$\text{CAR—(TIME)}_n\text{—INH}$$

wherein:

CAR is a carrier moiety from which —(TIME)$_n$—INH is released during color development;

TIME is a timing group;

INH is comprised of a development inhibitor moiety selected from the group consisting of oxazole, thiazole, diazole, oxathiazole, triazole, thiatriazole, benzotriazole, tetrazole, benzimidazole, indazole, isoindazole, mercaptotriazole, mercaptotetrazole, selenotetrazole, mercaptothiazole, selenobenzothiazole, mercaptobenzoxazole, selenobenzoxazole, mercaptobenzimidazole, mercaptobenzothiazole, selenobenzimidazole, benzodiazole, mercaptooxadiazole, or benzisodiazole, the INH having an inhibitor potency greater than 1 (one), and n is 0, 1 or 2, wherein inhibitor potency, IS, of the INH compound is defined as:

$$IS = \frac{IN_{(test)}}{IN_{(control)}}$$

where $IN_{(test)}$ is the inhibitor number of INH and $IN_{(control)}$ is the inhibitor number for 1-phenyl-5-mercapto-1,2,3,4-tetrazole;

the method comprising first treating the element with a black and white developer to develop exposed silver grains, then fogging non-exposed silver halide grains, then treating the element with a color developer.

13. A method in accordance with claim 12 wherein INH has a structure selected from

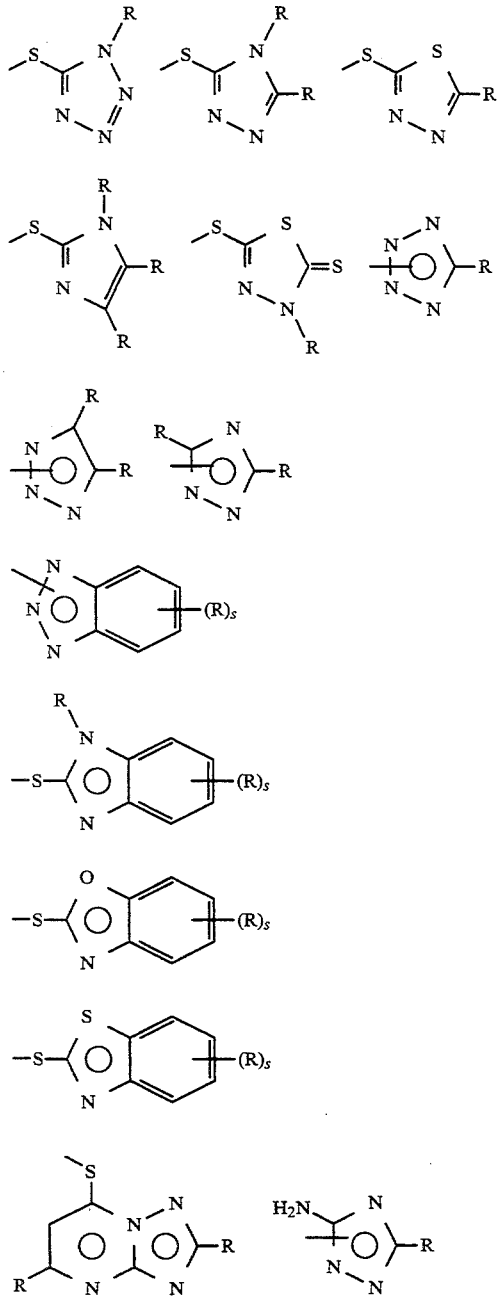

-continued

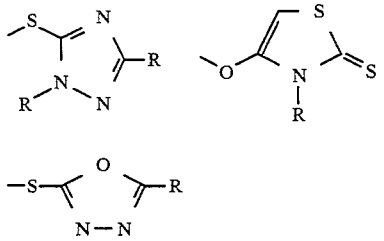

wherein R is a substituted or unsubstituted alkyl group, hydrogen, halogen, a substituted or unsubstituted aryl group, a 5- or 6-membered heterocyclic ring, alkoxy group, aryloxy group, alkoxycarbonyl group, arlyoxycarbonyl group, amino group, sulfamoyl group, sulfonamido group, sulfoxyl group carbamoyl group, alkylsulfo group, arylsulfo group, hydroxy group, aryloxycarbonylamino group, alkoxycarbonylamino group, acylamino group, ureido group, arylthio group, alkylthio group, cyano group, and wherein when R is either a substituted alkyl group or a substituted aryl group, the alkyl group or aryl group is substituted by a hydrogen, halogen, alkyl group, 5- or 6-membered heterocyclic ring, alkoxy group, aryloxy group, alkoxycarbonyl group, aryloxycarbonyl group, amino group, sulfamoyl group, sulfonamido group, sulfoxyl group, carbamoyl group, alkylsulfo group, arylsulfo group, hydroxy group, aryloxycarbonylamino group, alkoxycarbonylamino group, acylamino group, ureido group, arylthio group, alkylthio group, or cyano group, and s is 1 to 4.

14. A method in accordance with claim 12 wherein INH where preferred INH are selected from:

INH-1

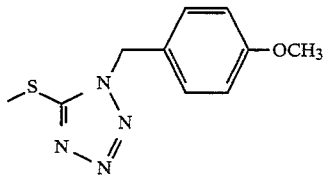

INH-2

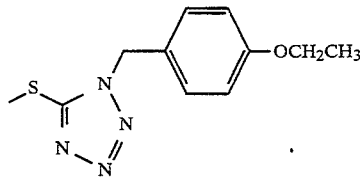

INH-3

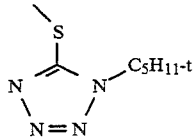

INH-4

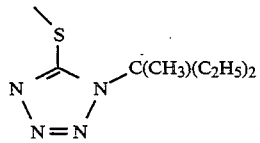

-continued

INH-5

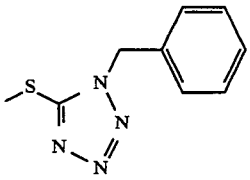

INH-6

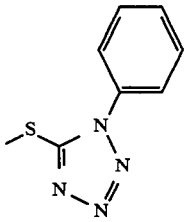

INH-7

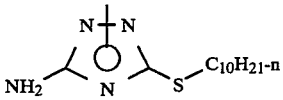

INH-8

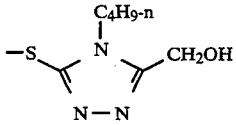

INH-9

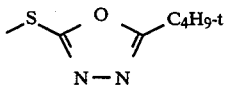

INH-9

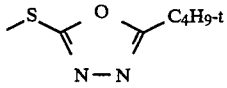

INH-10

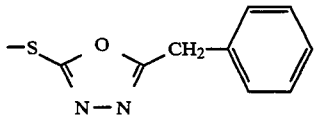

INH-11

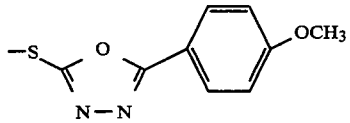

INH-12

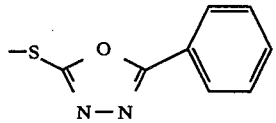

INH-13

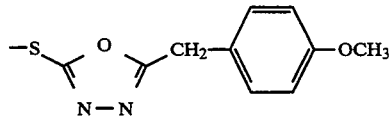

-continued

INH-14

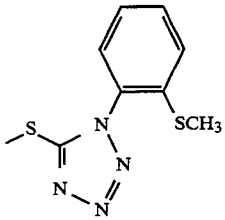

INH-15

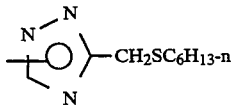

INH-16

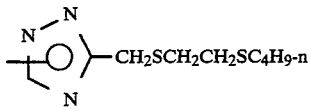

INH-17

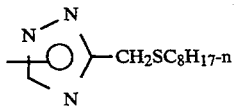

INH-18

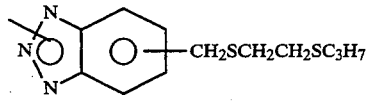

INH-19

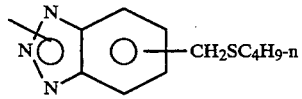

INH-20

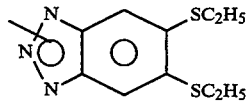

INH-21

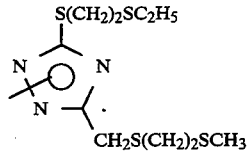

INH-22

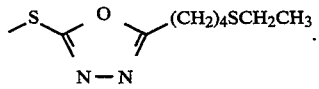

15. A method of processing a color reversal method having:

a support having thereon at least one photographic silver halide emulsion layer, the element having at least one red sensitive layer, at least one green sensitive layer and at least one blue sensitive layer and a image modifying compound which provides saturation in colors while providing less saturation in other colors and capable of releasing a development inhibitor compound having the structural formula $$CAR—(TIME)_n—INH$$

wherein:

CAR is a carrier moiety from which —(TIME)-$_n$—INH is released during color development;

TIME is a timing group;

INH is comprised of a development inhibitor moiety selected from the group consisting of oxazole, thiazole, diazole, oxathiazole, triazole, thiatriazole, benzotriazole, tetrarole, benzimidazole, indazole, isoindazole, mercaptotriazole, mercaptotetrazole, selenotetrazole, mercaptothiazole, selenobenzothiazole, mercaptobenzoxazole, selenobenzoxazole, mercaptobenzimidazole, mercaptobenzothiazole, selenobenzimidazole, benzodiazole, mercaptooxadiazole, or benzisodiazole, the INH having an inhibitor potency greater than 1 (one), and n is 0, 1 or 2, wherein inhibitor potency, IS, of the INH compound is defined as:

$$IS = \frac{IN_{(test)}}{IN_{(control)}}$$

where $IN_{(test)}$ is the inhibitor number of INH and $IN_{(control)}$ is the inhibitor number for 1-phenyl-5-mercapto-1,2,3,4-tetrazole;

the method comprising first treating the element with a black and white developer to develop exposed silver grains then fogging non-exposed silver halide grains, then treating the element with a color developer.

16. A method of processing a color reversal method having:

a support bearing a red-sensitive, cyan dye-forming unit, a green-sensitive, magenta dye-forming unit, and a blue-sensitive, yellow dye-forming unit, each unit comprising at least one photosensitive silver halide layer and and image dye-forming compound;

said element containing an interimage effect-controlling means;

said interimage effect-controlling means being characterized as having the capability of simultaneously forming a red image of high relative chroma and a yellow-red tint image of substantially lower chroma when said element is exposed to a red color standard object and a yellow-red tint color standard object and thereafter developed;

the resulting said images having a red reproduction coefficient equal to or greater than 0.88 and a ratio of red reproduction coefficient to yellow-red tint reproduction coefficient equal to or greater than 1.15;

said interimage effect-controlling means comprising a compound having the structural formula $$CAR—(TIME)_n—INH$$

wherein:

CAR is a carrier moiety from which —(TIME)-$_n$—INH is released during color development;

TIME is a timing group;

INH is comprised of a development inhibitor moiety selected from the group consisting of oxazole, thiazole, diazole, oxathiazole, triazole, thiatriazole, benzotriazole, tetrazole, benzimidazole, indazole, isoindazole, mercaptotriazole, mercaptotetrazole, selenotetrazole, mercaptothiazole, selenobenzothiazole, mercaptobenzoxazole, selenobenzoxazole, mercaptobenzimidazole, mercaptobenzothiazole, selenobenzimidazole, benzodiazole, mercaptooxadiazole, or benzisodiazole, the INH having an inhibitor potency greater than 1 (one), and n is 0, 1 or 2, wherein inhibitor potency, IS, of the INH compound is defined as:

$$IS = \frac{IN_{(test)}}{IN_{(control)}}$$

where $IN_{(test)}$ is the inhibitor number of INH and $IN_{(control)}$ is the inhibitor number for 1-phenyl-5-mercapto-1,2,3,4-tetrazole;

the method comprising first treating the element with a black and white developer to develop exposed silver grains, then fogging non-exposed silver halide grains, then treating the element with a color developer.

17. A method in accordance with claim 16 wherein INH has a structure selected from

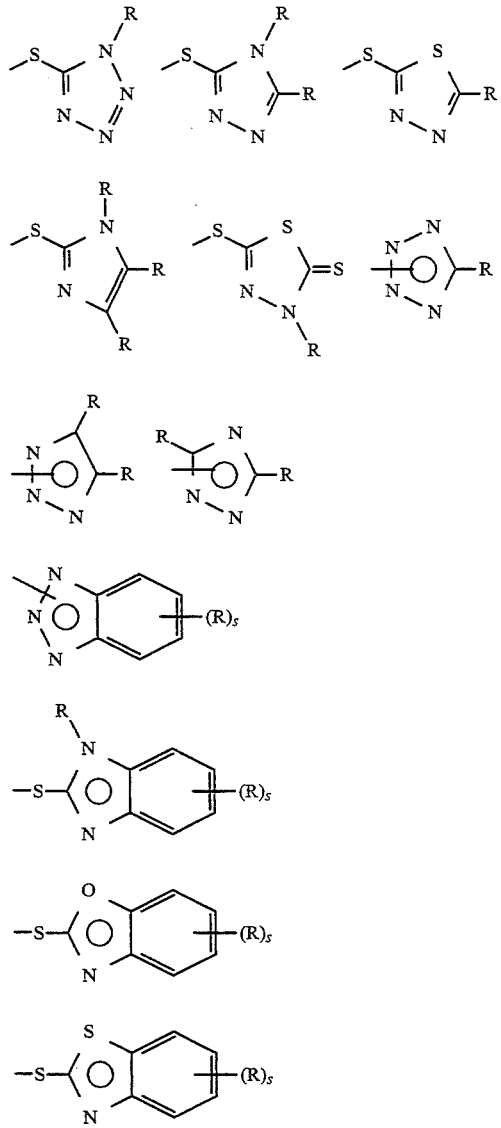

-continued

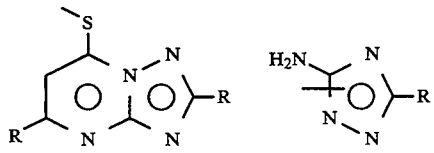

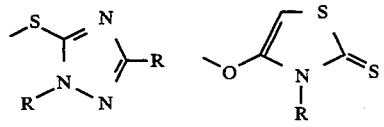

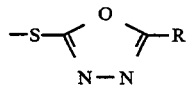

wherein R is a substituted or unsubstituted alkyl group, hydrogen, halogen, a substituted or unsubstituted aryl group, a 5- or 6-membered heterocyclic ring, alkoxy group, aryloxy group, alkoxycarbonyl group, arlyoxycarbonyl group, amino group, sulfamoyl group, sulfonamido group, sulfoxyl group carbamoyl group, alkylsulfo group, arylsulfo group, hydroxy group, aryloxycarbonylamino group, alkoxycarbonylamino group, acylamino group, ureido group, arylthio group, alkylthio group, cyano group, wherein when R is either a substituted alkyl group or a substituted aryl group, the alkyl group or aryl group is substituted by a hydrogen, halogen, alkyl group, 5- or 6-membered heterocyclic ring, alkoxy group, aryloxy group, alkoxycarbonyl group, aryloxycarbonyl group, amino group, sulfamoyl group, sulfonamido group, sulfoxyl group, carbamoyl group, alkylsulfo group, arylsulfo group, hydroxy group, aryloxycarbonylamino group, alkoxycarbonylamino group, acylamino group, ureido group, arylthio group, alkylthio group, or cyano group, and s is 1 to 4.

18. A method in accordance with claim 16 wherein INH is selected from:

INH-1

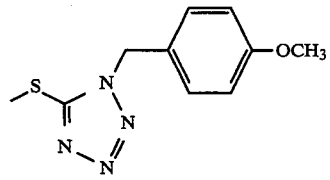

INH-2

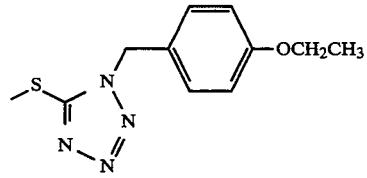

INH-3

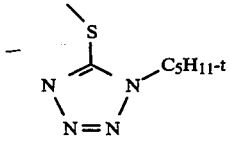

-continued

INH-4

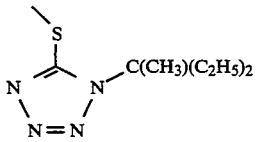

INH-5

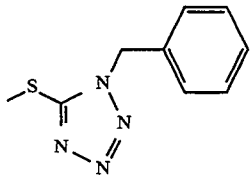

INH-6

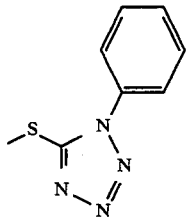

INH-7

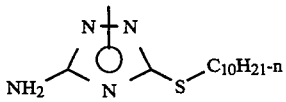

INH-8

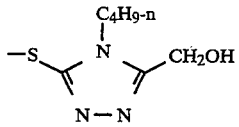

INH-9

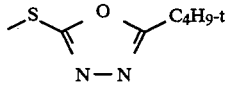

INH-9

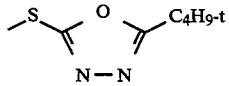

INH-10

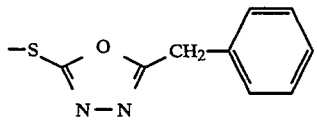

INH-1

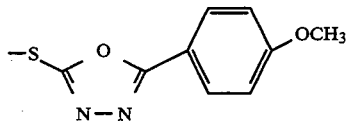

INH-12

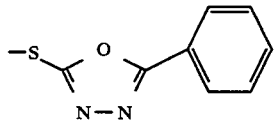

INH-13

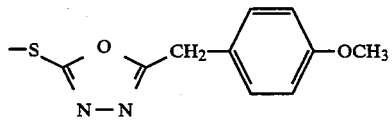

-continued

INH-14

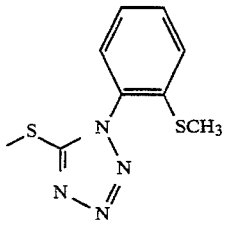

INH-15

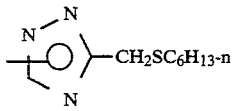

INH-16

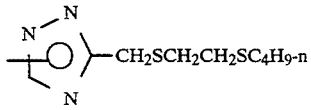

INH-17

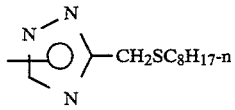

INH-18

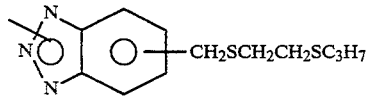

INH-19

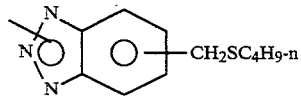

INH-20

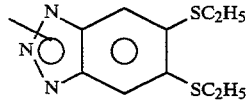

INH-21

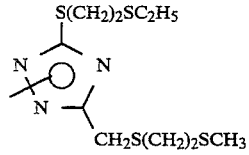

INH-22

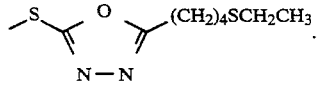

19. The method in accordance with claim 16 wherein CAR is a coupler moiety.

20. The method in accordance with claim 19 wherein the coupler moiety is ballasted.

21. The method in accordance with claim 16 wherein —(TIME)$_n$—INH is bonded to a coupling position of the coupler moiety.

22. The method in accordance with claim 19 wherein the method is unballasted and the TIME moiety attached to the method is ballasted.

23. The method in accordance with claim 22 wherein CAR is a coupler moiety.

24. The method in accordance with claim 16 wherein CAR is a moiety which can cross-oxidize with oxidized color developer, and is selected from the class consisting of hydrazides and hydroquinones.

25. The method in accordance with claim 16 wherein the compound is present in the element from 0.002 to about 0.35 g/m$^2$.

26. The method in accordance with claim 16 wherein the compound is present in the element from about 0.005 to about 0.15 g/m$^2$.

27. A method of processing a color reversal photographic element having:

a support bearing a red-sensitive, cyan dye-forming unit, a green-sensitive, magenta dye-forming unit, and a blue-sensitive, yellow dye-forming unit, each unit comprising at least one photosensitive silver halide layer and and image dye-forming compound;

said element containing an interimage effect-controlling means;

said interimage effect-controlling means being characterized as having the capability of simultaneously forming a red image of high relative chroma and a yellow-red tint image of substantially lower chroma when said element is exposed to a red color standard object and a yellow-red tint color standard object and thereafter developed;

said red color standard object having CIELab values for $D_{55}$ reference white a*=30.46, b*=19.16, C*=35.98, L*=40.12; said yellow-red tint color standard object having CIELab values a*=17.26, b*=18.01, C*=24.95, L*=66.98;

the resulting said images having a red reproduction coefficient equal to or greater than 0.88 and a ratio of red reproduction coefficient to yellow-red tint reproduction coefficient equal to or greater than 1.15;

said interimage effect-controlling means comprising a compound having the structural formula $$\text{CAR—(TIME)}_n\text{—INH}$$

wherein:

CAR is a carrier moiety from which —(TIME)$_n$—INH is released during color development;

TIME is a timing group;

INH is comprised of a development inhibitor moiety selected from the group consisting of oxazole, thiazole, diazole, oxathiazole, triazole, thiatriazole, benzotriazole, tetrazole, benzimidazole, indazole, isoindazole, mercaptotriazole, mercaptotetrazole, selenotetrazole, mercaptothiazole, selenobenzothiazole, mercaptobenzoxazole, selenobenzoxazole, mercaptobenzimidazole, mercaptobenzothiazole, selenobenzimidazole, benzodiazole, mercaptooxadiazole, or benzisodiazole, the INH having an inhibitor potency greater than 1 (one), and n is 0, 1 or 2, wherein inhibitor potency., IS, of the INH compound is defined as:

$$IS = \frac{IN_{(test)}}{IN_{(control)}}$$

where $IN_{(test)}$ is the inhibitor number of INH and $IN_{(control)}$ is the inhibitor number for 1-phenyl-5-mercapto-1,2,3,4-tetrazole;

the method comprising first treating the element with a black and white developer to develop exposed silver grains, then fogging non-exposed silver halide grains, then treating the element with a color developer.

28. A method of processing a color reversal photographic element having:

a support having thereon at least one photographic silver halide emulsion layer, the element having at least one red sensitive layer, at least one green sensitive layer and at least one blue sensitive layer and a image modifying compound, wherein said element is capable of an improvement in sharpness of at least 1 CMT when developed in a color reversal developer process comprising a non-chromogenic developing step and a chromogenic developing step, wherein the improvement in sharpness results from said chromogenic developing step, said image modifying compound having the structural formula $$CAR—(TIME)_n—INH$$

wherein:

CAR is a carrier moiety from which —(TIME)$_n$—INH is released during color development;

TIME is a timing group;

INH is comprised of a development inhibitor moiety selected from the group consisting of oxazole, thiazole, diazole, oxathiazole, triazole, thiatriazole, benzotriazole, tetrazole, benzimidazole, indazole, isoindazole, mercaptotriazole, mercaptothiadiazole, mercaptotetrazole, selenotetrazole, mercaptothiazole, selenobenzothiazole, mercaptobenzoxazole, selenobenzoxazole, mercaptobenzimidazole, mercaptobenzothiazole, selenobenzimidazole, benzodiazole, mercaptooxadiazole, or benzisodiazole, the INH having an inhibitor potency greater than 1 (one), and n is 0, 1 or 2, wherein inhibitor potency, IS, of the INH compound is defined as:

$$IS = \frac{IN_{(test)}}{IN_{(control)}}$$

where $IN_{(test)}$ is the inhibitor number Of INH and $IN_{(control)}$ is the inhibitor number for 1-phenyl-5-mercapto-1,2,3,4-tetrazole;

the method comprising first treating the element with black and white developer to develop exposed silver grains, then fogging non-exposed silver halide grains, then treating the element with a color developer.

29. A method in accordance with claim 28 wherein INH has a structure selected from

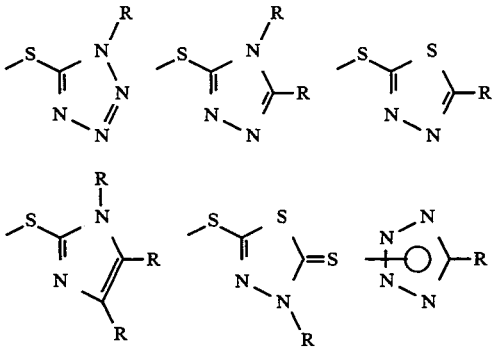

-continued

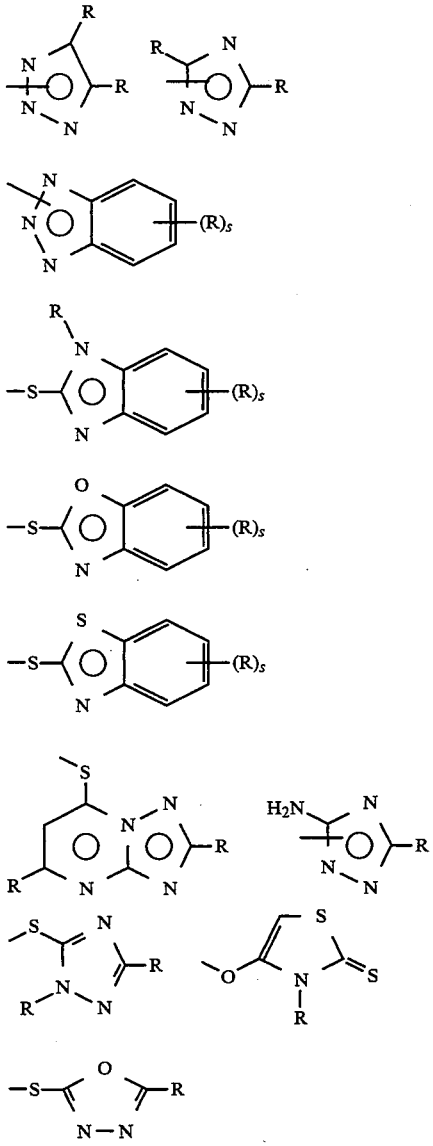

wherein R is a substituted or unsubstituted alkyl group, hydrogen, halogen, a substituted or unsubstituted aryl group, a 5- or 6-membered heterocyclic ring, alkoxy group, aryloxy group, alkoxycarbonyl group, arlyoxycarbonyl group, amino group, sulfamoyl group, sulfonamido group, sulfoxyl group carbamoyl group, alkylsulfo group, arylsulfo group, hydroxy group, aryloxycarbonylamino group, alkoxycarbonylamino group, acylamino group, ureido group, arylthio group, alkylthio group, cyano group, wherein when R is either a substituted alkyl group or a substituted aryl group, the alkyl group or aryl group is substituted by a hydrogen, halogen, alkyl group, 5- or 6-membered heterocyclic ring, alkoxy group, aryloxy group, alkoxycarbonyl group, aryloxycarbonyl group, amino group, sulfamoyl group, sulfonamido group, sulfoxyl group, carbamoyl group, alkylsulfo group, arylsulfo group, hydroxy group, aryloxycarbonylamino group, alkoxycarbonylamino group, acylamino group, ureido group, arylthio group, alkylthio group, or cyano group, and s is 1 to 4.

30. A method in accordance with claim 28 wherein INH is selected from:
INH-1
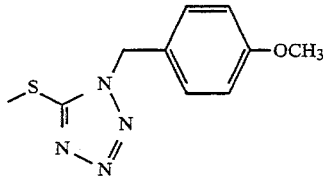
INH-2
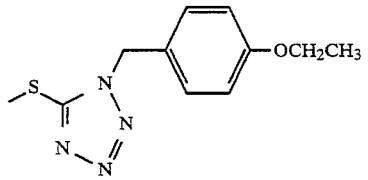
INH-3
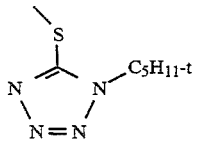
INH-4
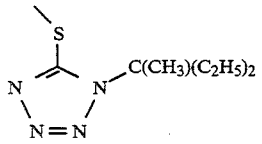
INH-5
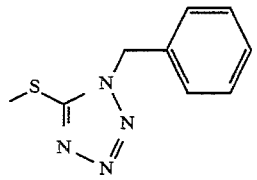
INH-6
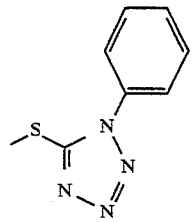
INH-7
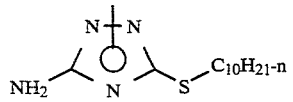
INH-8
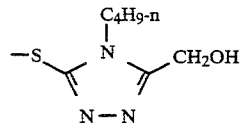
INH-9
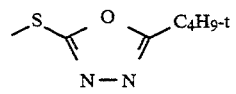
INH-9
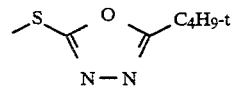
-continued
INH-10
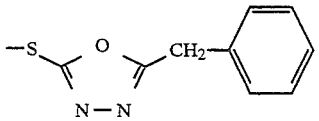
INH-11
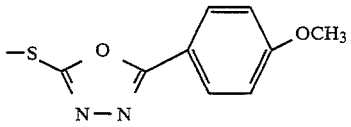
IN-12
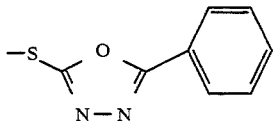
INH-13
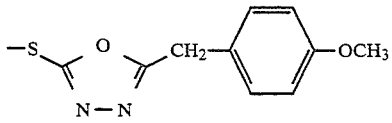
INH-14
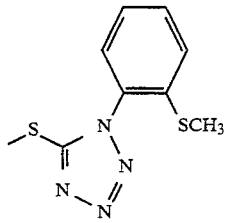
INH-15
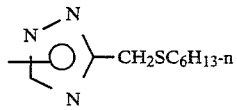
INH-16
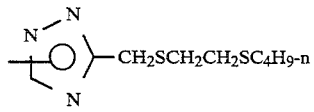
INH-17
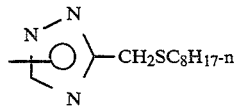
INH-18
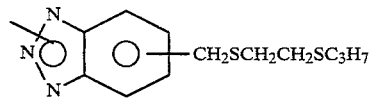
INH-19
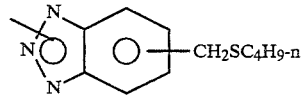
INH-20
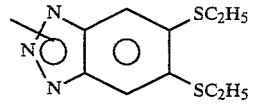
INH-21
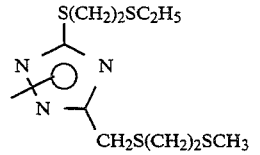
INH-22
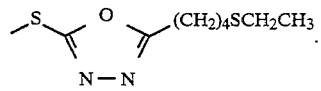
* * * * *